US008535207B2

(12) United States Patent
Musachio

(10) Patent No.: US 8,535,207 B2
(45) **Date of Patent: *Sep. 17, 2013**

(54) BI-DIRECTIONAL TENSIONING APPARATUS

(71) Applicant: Nicholas R. Musachio, St. Paul, MN (US)

(72) Inventor: Nicholas R. Musachio, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/645,285

(22) Filed: Oct. 4, 2012

(65) Prior Publication Data

US 2013/0025091 A1 Jan. 31, 2013

Related U.S. Application Data

(63) Continuation of application No. 12/724,193, filed on Mar. 15, 2010, now Pat. No. 8,303,471.

(51) Int. Cl.
*A63B 21/05* (2006.01)

(52) U.S. Cl.
USPC ..... 482/121; 482/124; 482/122

(58) Field of Classification Search
USPC ..... 482/121–129, 148, 35–36
See application file for complete search history.

(56) References Cited

U.S. PATENT DOCUMENTS 2,205,161 A * 6/1940 Vick ..... 482/49
2,930,614 A * 3/1960 McIntosh ..... 482/126
3,357,702 A * 12/1967 Van Saders ..... 482/49
3,636,594 A 1/1972 Faivre
3,815,904 A * 6/1974 Weiss et al. ..... 482/123
4,226,412 A * 10/1980 Panepinto ..... 482/49
4,239,212 A 12/1980 Hickey
4,279,601 A * 7/1981 Cobelli ..... 434/247
4,328,964 A 5/1982 Walls
4,463,948 A 8/1984 Mohr
4,605,223 A * 8/1986 Rainville ..... 482/112
4,623,145 A * 11/1986 Paraskevakos ..... 482/112
4,708,341 A * 11/1987 Paraskevakos ..... 482/120
5,013,036 A * 5/1991 Anchia ..... 482/122
5,062,184 A 11/1991 Rowland
5,078,388 A * 1/1992 Dempsey, Jr. ..... 482/49
5,125,878 A * 6/1992 Wingate et al. ..... 482/49
5,131,650 A * 7/1992 Hall ..... 482/126
5,163,413 A * 11/1992 Carella ..... 124/90
5,222,701 A 6/1993 Rowland
D353,859 S * 12/1994 Grey ..... D21/684
5,397,288 A * 3/1995 Sayre ..... 482/125
5,409,330 A 4/1995 Naines et al.
5,592,928 A * 1/1997 Frasier ..... 124/1
5,720,699 A 2/1998 Musachio et al.
5,771,912 A 6/1998 Swetish
5,772,371 A 6/1998 Ackerman
6,145,170 A 11/2000 Bernard et al.
6,179,750 B1 1/2001 Lonergan
6,267,711 B1 7/2001 Hinds
6,467,107 B1 10/2002 Glover et al.

(Continued)

FOREIGN PATENT DOCUMENTS

WO 2007/104509 9/2007

*Primary Examiner* — Stephen Crow
(74) *Attorney, Agent, or Firm* — Fish & Richardson P.C.

(57) ABSTRACT

A bi-directional tensioning apparatus including one or more elongate resilient members, one or more support members, one or more first guide members, and one or more optional second guide members is provided. A method of using the bi-directional tensioning apparatus is also provided.

20 Claims, 16 Drawing Sheets

(56) References Cited

U.S. PATENT DOCUMENTS

| | | | | |
|---|---|---|---|---|
| 7,192,390 | B2 | 3/2007 | Berard | |
| 7,322,907 | B2 | 1/2008 | Bower | |
| 7,465,259 | B2 | 12/2008 | Mok | |
| 7,494,450 | B2 | 2/2009 | Solomon | |
| 7,611,442 | B1 | 11/2009 | Myrland | |
| 7,798,945 | B2 | 9/2010 | Ko | |
| 7,805,816 | B1 | 10/2010 | Thorne et al. | |
| 7,819,451 | B2 | 10/2010 | Yoshida | |
| 7,854,694 | B1 * | 12/2010 | Frunzi | 482/124 |
| 8,079,942 | B2 * | 12/2011 | Anderson | 482/121 |
| 8,303,471 | B2 * | 11/2012 | Musachio | 482/121 |
| 2006/0105893 | A1 | 5/2006 | Chen | |
| 2007/0004571 | A1 | 1/2007 | Gonzalez | |

* cited by examiner

BI-DIRECTIONAL TENSIONING APPARATUS

CROSS-REFERENCE TO RELATED APPLICATIONS

This application is a continuation of and claims priority under 35 U.S.C. §120 to U.S. application Ser. No. 12/724,193, filed on Mar. 15, 2010, the entire contents of which is incorporated herein by reference.

BACKGROUND OF THE INVENTION

Elastic bands, such as bungee cords, are commonly used to provide tension in tie-down equipment, exercise equipment, physical rehabilitation equipment, portable scaffolding, and the like. However, bungee cords with hooks pose considerable danger to the user. Typically, the user hooks one end of the bungee cord to the equipment, pulls the bungee cord to tighten it, and hooks the other end of the bungee cord to the equipment. If any of the metal hooks come loose during this process, the free metal hook can act like a bullet and hit the user with considerable force to severely bruise the skin or to damage to the user's eye.

Further, any device that attaches to the elastic body of the bungee cord runs the risk of damaging the elastic member by abrasion, shearing, and tearing, thereby creating increased risk to the user.

Accordingly, there is a need for an elastic member and apparatus for securing the elastic member that does not pose physical danger to the user or damages the elastic member.

SUMMARY OF THE INVENTION

The present invention provides a bi-directional tensioning apparatus that includes, for example, an elongate resilient member, a support member, a first guide member, and a second guide member. The bi-directional tensioning apparatus is able to hold the second guide member in an equilibrium position intermediate the base end and the remote end of the support member. When a force is applied to the second guide member, the bi-directional tensioning apparatus exerts an opposing force.

The unique structure of the bi-directional tensioning apparatus preserves the elongate resilient member strength and integrity by not squeezing, bending, or constricting the elongate resilient member during use. Therefore, no weak spots in the elongate resilient member are created by tearing, shearing, and abrading. The elongate resilient member includes, for example, enlargements, which are captured by the support member, the first guide member, and the second guide member to provide bi-directional tension.

The bi-directional tensioning apparatus as described herein, find applications, for example, tie-down equipment, exercise equipment, physical rehabilitation equipment, portable scaffolding, and the like.

The present invention provides a bi-directional tensioning apparatus. The bi-directional tensioning apparatus includes:

one or more elongate resilient members each having a base end and a remote end, wherein the one or more elongate resilient members each include a first elastic material with a first enlargement at the base end and one or more spaced-apart enlargements along the length of each of the one or more elongate resilient members;

one or more support members each having a base end and a remote end, wherein the one or more support members each include one or more optional first cavities at each remote end for receiving and holding the one or more elongate resilient members;

one or more first guide members each having a base end and a remote end, wherein the one or more first guide members is each independently connected at or proximate to the base end of each of the one or more support members and extending generally perpendicular thereto, wherein the one or more first guide members each independently include a first hole extending through the one or more first guide members and generally parallel to the one or more support members;

one or more optional couplers for independently securing one of the one or more spaced-apart enlargements, and one or more optional second guide members each having a base end and a remote end, wherein each of the one or more optional second guide members is movably mounted on each of the one or more support members between the one or more first guide members and the remote end of each of the one or more support members and extending generally perpendicular thereto, wherein the one or more optional second guide members each independently include a first snap-fit device on the base end and an optional second snap-fit device on the remote end for independently receiving one of the one or more support members, wherein the one or more optional second guide members each include one or more connectors for independently securing one of the one or more spaced-apart enlargements, wherein the one or more connectors each extend through each of the one or more optional second guide members and generally parallel to the one or more support members, wherein the one or more optional second guide members each independently rest at a point of equilibrium intermediate the base end and the remote end of each of the one or more support members.

In one embodiment, if one support member and one first guide member are present, then the one first guide member penetrates opposite sidewalls of the support member or forms a third snap-fit device with the support member to form an interconnecting frame. In one embodiment, if one support member and two first guide members are present, then the two first guide members are each independently connected to opposite sidewalls of support member or form a fourth snap-fit device with the support member to form an interconnecting frame. In one embodiment, if one support member and two second guide members are present, then each of the one or more first snap-fit devices accepts the one support member.

The present invention provides a bi-directional tensioning apparatus. The bi-directional tensioning apparatus includes:

one or more elongate resilient members each having a base end and a remote end, wherein the one or more elongate resilient members each comprise a first elastic material with a first enlargement at the base end and one or more spaced-apart enlargements along the length of each of the one or more elongate resilient members;

one or more support members each having a base end and a remote end, wherein the one or more support members each comprise one or more optional first cavities at each remote end for receiving and holding the one or more elongate resilient members;

one or more first guide members each having a base end and a remote end, wherein the one or more first guide members is each independently connected at or proximate to the base end of each of the one or more support members and extending generally perpendicular thereto, wherein the one or more first guide members each independently comprise a first hole extending through the one or more first guide members and generally parallel to the one or more support members; and one or more second guide members each having a base end and a remote end, wherein each of the one or more second guide members is movably mounted on each of the one or more support members between the one or more first guide members and the remote end of each of the one or more support members and extending generally perpendicular thereto, wherein the one or more second guide members each independently comprise a first snap-fit device on the base end and an optional second snap-fit device on the remote end for independently receiving one of the one or more support members, wherein the one or more second guide members each comprise one or more connectors for independently securing one of the one or more spaced-apart enlargements, wherein the one or more connectors each extend through each of the one or more second guide members and generally parallel to the one or more support members, wherein the one or more second guide members each independently rest at a point of equilibrium intermediate the base end and the remote end of each of the one or more support members.

In one embodiment, the first enlargement at the base end has a thickness greater than or equal to the thicknesses of each the one or more spaced-apart enlargements. In another embodiment, the first enlargement at the base end, the one or more spaced-apart enlargements, or a combination thereof, each independently include the first elastic material, a knot of elastic material, a wooden material, a metal material, a plastic material, a second elastic material, or a combination thereof.

In yet another embodiment, each of the one or more optional first cavities has a width less than or equal to the thickness of the one or more spaced-apart enlargements and greater than or equal to the thickness of the one or more elongate resilient members.

In one embodiment, the diameter of the first hole is less than or equal to the thickness of the first enlargement and greater than or equal to the thickness of the one or more spaced-apart enlargements. In another embodiment, the one or more connectors each include one or more keyhole connectors, one or more adjustable clamps, one or more strictures, one or more slots, one or more grommets, one or more captures, or combinations thereof. In yet another embodiment, the one or more keyhole connectors each include a first hole, an optional second cavity, and a second hole, wherein the first hole intersects the second hole for passage of the one or more elongate resilient members from the first hole to the second hole, wherein if the optional second cavity is present, the first hole intersects the optional second cavity having an intersection with the second hole such the one or more elongate resilient members may pass from the first hole through the optional second cavity to the second hole.

In one embodiment, the diameter of the first hole in each of the one or more keyhole connectors is greater than or equal to the thickness of the one or more spaced-apart enlargements. In another embodiment, the diameter of a second hole in each of the one or more keyhole connectors is less than or equal to the thickness of the one or more spaced-apart enlargements. In yet another embodiment, the width of a key in each of the one or more keyhole connectors is less than or equal to the thickness of the one or more spaced-apart enlargements and greater than or equal to the thickness of the one or more elongate resilient members.

In one embodiment, the one or more optional second guide members each independently slides along each of the one or more support members. In another embodiment, the one or more support members each independently include one or more couplers located at or proximate each base end of each of the one or more support members. In yet another embodiment, the one or more couplers are independently connected to the one or more first guide members by one or more snap buttons disposed within the base end of each of the one or more first guide members.

In one embodiment, one support member, one first guide member, and one second guide member are present or wherein one support member, two first guide members, and two second guide members are present, or wherein two support members, one first guide member, and one second guide member are present.

In one embodiment, each of the one or more support members is a rigid support member. In another embodiment, each of the one or more support members is a non-rigid support member. In yet another embodiment, each of the one or more support members is independently a rigid support member or a non-rigid support member.

In one embodiment, each of the one or more first guide members is a rigid first guide member. In another embodiment, each of the one or more first guide members is a non-rigid first guide member. In yet another embodiment, each of the one or more first guide members is independently a rigid first guide member or a non-rigid first guide member.

In one embodiment, each of the one or more optional second guide members is a rigid second guide member. In another embodiment, each of the one or more optional second guide members is a non-rigid second guide member. In yet another embodiment, each of the one or more optional second guide members is independently a rigid second guide member or a non-rigid second guide member.

The present invention provides a bi-directional tensioning apparatus. The bi-directional tensioning apparatus includes:

one or more elongate resilient members each having a base end and a remote end, wherein the one or more elongate resilient members each include a first elastic material with a first enlargement at the base end and one or more spaced-apart enlargements along the length of each of the one or more elongate resilient members, wherein the first enlargement at the base end has a thickness greater than or equal to the thicknesses of each the one or more spaced-apart enlargements, wherein the first enlargement at the base end, the one or more spaced-apart enlargements, or a combination thereof, each include the first elastic material;

two support members each having a base end and a remote end, wherein the two support members each include a first cavity at each remote end for receiving and holding the one or more elongate resilient members, wherein each first cavity has a width less than or equal to the thickness of the one or more spaced-apart enlargements and greater than or equal to the thickness of the one or more elongate resilient members;

a first guide member having a base end and a remote end, wherein the first guide member is connected at or proximate to the base end of each of the two support members and extending generally perpendicular thereto, wherein the first guide member includes a first hole extending through the first guide member and generally parallel to the two support members, wherein the diameter of the first hole is less than or equal to the thickness of the first enlargement and greater than or equal to the thickness of the one or more spaced-apart enlargements; and a second guide member having a base end and a remote end, wherein the second guide member is movably mounted on the two support members between the first guide member and the remote end of each of the two support members and extending generally perpendicular thereto, wherein the second guide member rests at a point of equilibrium intermediate the base end and the remote ends of the two support members, wherein the second guide member includes a first snap-fit device on the base end and a second snap-fit device on the remote end for independently receiving the two support members, wherein the second guide member includes one or more keyhole connectors for independently securing one of the one or more spaced-apart enlargements, wherein the one or more keyhole connectors each extend through the second guide member and generally parallel to the two support members, wherein the one or more keyhole connectors each include a first hole, a cavity, and a second hole, wherein the first hole intersects the second cavity having an intersection with the second hole such the one or more elongate resilient members may pass from the first hole through the second cavity to the second hole, wherein the diameter of the first hole in each of the one or more keyhole connectors is greater than or equal to the thickness of the one or more spaced-apart enlargements, wherein the diameter of a second hole in each of the one or more keyhole connectors is less than or equal to the thickness of the one or more spaced-apart enlargements, wherein the width of a second cavity in each of the one or more keyhole connectors is less than or equal to the thickness of the one or more spaced-apart enlargements and greater than or equal to the thickness of the one or more elongate resilient members.

In one embodiment, the second guide member slides along each of the two support members. In another embodiment, the elastic material is flexible and stretchable. In yet another embodiment, the two support members each independently include one or more couplers located at or proximate each base end of each of the two support members.

In one embodiment, the one or more couplers are independently connected to the first guide member by one or more snap buttons disposed within the base end of the first guide member.

In one embodiment, each of the one or more support members is a rigid support member.

In another embodiment, each of the one or more support members is a non-rigid support member. In yet another embodiment, each of the one or more support members is independently a rigid support member or a non-rigid support member.

In one embodiment, each of the one or more first guide members is a rigid first guide member. In another embodiment, each of the one or more first guide members is a non-rigid first guide member. In yet another embodiment, each of the one or more first guide members is independently a rigid first guide member or a non-rigid first guide member.

In one embodiment, each of the one or more optional second guide members is a rigid second guide member. In another embodiment, each of the one or more optional second guide members is a non-rigid second guide member. In yet another embodiment, each of the one or more optional second guide members is independently a rigid second guide member or a non-rigid second guide member.

The present invention provides a method for using a bi-directional tensioning apparatus. The method includes:

providing a bi-directional tensioning apparatus including:

one or more elongate resilient members each having a base end and a remote end, wherein the one or more elongate resilient members each include a first elastic material with a first enlargement at the base end and one or more spaced-apart enlargements along the length of each of the one or more elongate resilient members;

one or more support members each having a base end and a remote end, wherein the one or more support members each include one or more optional first cavities at each remote end for receiving and holding the one or more elongate resilient members;

one or more first guide members each having a base end and a remote end, wherein the one or more first guide members is each independently connected at or proximate to the base end of each of the one or more support members and extending generally perpendicular thereto, wherein the one or more first guide members each independently include a first hole extending through the one or more first guide members and generally parallel to the one or more support members;

one or more optional couplers for independently securing one of the one or more spaced-apart enlargements, and one or more optional second guide members each having a base end and a remote end, wherein each of the one or more optional second guide members is movably mounted on each of the one or more support members between the one or more first guide members and the remote end of each of the one or more support members and extending generally perpendicular thereto, wherein the one or more optional second guide members each independently include a first snap-fit device on the base end and an optional second snap-fit device on the remote end for independently receiving one of the one or more support members, wherein the one or more optional second guide members each include one or more connectors for independently securing one of the one or more spaced-apart enlargements, wherein the one or more connectors each extend through each of the one or more optional second guide members and generally parallel to the one or more support members;

displacing the one or more optional couplers or the one or more optional second guide members; and engaging the one or more spaced-apart enlargements in the one or more optional couplers or the one or more connectors to provide that the one or more optional couplers or the one or more optional second guide members each independently rest at a point of equilibrium intermediate the base end and the remote end of each of the one or more support members.

The present invention provides a bi-directional tensioning apparatus. The bi-directional tensioning apparatus includes:

one or more elongate resilient members each having a base end and a remote end, wherein the one or more elongate resilient members each comprise a first elastic material with a first enlargement at the base end and one or more spaced-apart enlargements along the length of each of the one or more elongate resilient members;

one or more support members each having a base end and a remote end, wherein the one or more support members each comprise one or more optional first cavities at each remote end for receiving and holding the one or more elongate resilient members;

one or more first guide members each having a base end and a remote end, wherein the one or more first guide members is each independently connected at or proximate to the base end of each of the one or more support members and extending generally perpendicular thereto, wherein the one or more first guide members each independently comprise a first hole extending through the one or more first guide members and generally parallel to the one or more support members; and one or more couplers for independently securing one of the one or more spaced-apart enlargements.

The present invention provides a method for using a bi-directional tensioning apparatus. The method includes:

providing a bi-directional tensioning apparatus including:

one or more elongate resilient members each having a base end and a remote end, wherein the one or more elongate resilient members each comprise a first elastic material with a first enlargement at the base end and one or more spaced-apart enlargements along the length of each of the one or more elongate resilient members;

one or more support members each having a base end and a remote end, wherein the one or more support members each comprise one or more optional first cavities at each remote end for receiving and holding the one or more elongate resilient members;

one or more first guide members each having a base end and a remote end, wherein the one or more first guide members is each independently connected at or proximate to the base end of each of the one or more support members and extending generally perpendicular thereto, wherein the one or more first guide members each independently comprise a first hole extending through the one or more first guide members and generally parallel to the one or more support members; and one or more couplers for independently securing one of the one or more spaced-apart enlargements.

displacing the one or more couplers; and engaging the one or more spaced-apart enlargements in the one or more couplers to provide that the one or more couplers rests at a point of equilibrium intermediate the base end and the remote end of each of one or more elongate resilient members.

The present invention provides a bi-directional tensioning apparatus. The bi-directional tensioning apparatus includes:

two elongate resilient members each having a base end and a remote end, wherein the two elongate resilient members each comprise a first elastic material with a first enlargement at the base end and one or more spaced-apart enlargements along the length of each of the two elongate resilient members;

two supporting frames each having a first support member, a second support member coupled perpendicular to the first support member, and a third support member couple perpendicular to the second support member and extending from the second support member in the same direction as the first support member, wherein the first support member and the third support member each comprise a cavity for receiving and holding one of the two elongate resilient members;

one or more guide members each having a base end and a remote end, wherein the one or more guide members is each independently connected to each of the two supporting frames and extending generally perpendicular thereto, wherein the two first support members each independently comprise a first hole extending through each of the two first support members and generally parallel to the each of the two second support members; and one cross member having a base end and a remote end, wherein the one cross member includes two connectors for independently securing one of the one or more spaced-apart enlargements along the length of each of the two elongate resilient members, wherein the one or more connectors each extend through each of the one cross member and generally parallel to the one or more guide members and perpendicular to the two supporting frames, wherein the one cross member rests at a point of equilibrium intermediate the base end and the remote end of each of two elongate resilient members.

The present invention provides a method for using a bi-directional tensioning apparatus. The method includes:

providing a bi-directional tensioning apparatus including:

two elongate resilient members each having a base end and a remote end, wherein the two elongate resilient members each comprise a first elastic material with a first enlargement at the base end and one or more spaced-apart enlargements along the length of each of the two elongate resilient members;

two supporting frames each having a first support member, a second support member coupled perpendicular to the first support member, and a third support member couple perpendicular to the second support member and extending from the second support member in the same direction as the first support member, wherein the first support member and the third support member each comprise a cavity for receiving and holding one of the two elongate resilient members;

one or more guide members each having a base end and a remote end, wherein the one or more guide members is each independently connected to each of the two supporting frames and extending generally perpendicular thereto, wherein the two first support members each independently comprise a first hole extending through each of the two first support members and generally parallel to the each of the two second support members; and one cross member having a base end and a remote end, wherein the one cross member includes two connectors for independently securing one of the one or more spaced-apart enlargements along the length of each of the two elongate resilient members, wherein the one or more connectors each extend through each of the one cross member and generally parallel to the one or more guide members and perpendicular to the two supporting frames, wherein the one cross member rests at a point of equilibrium intermediate the base end and the remote end of each of two elongate resilient members;

displacing the one cross member; and engaging the one or more spaced-apart enlargements in the one or more connectors to provide that the one cross member rests at a point of equilibrium intermediate the base end and the remote end of each of two elongate resilient members.

The present invention provides a bi-directional tensioning apparatus. The bi-directional tensioning apparatus includes:

one or more elongate resilient members each having a base end and a remote end, wherein the one or more elongate resilient members each comprise a first elastic material with one or more holes along the length of each of the one or more elongate resilient members;

one or more support members each having a base end and a remote end, wherein the one or more support members each comprise one or more optional first connectors at each base end and one or more second connectors at each remote end for receiving and holding the one or more holes along the length of each of the one or more elongate resilient members, wherein the one or more optional first connectors at each base end and the one or more second connectors at each remote end each extend through or are on the exterior surface of each of the one or more support members and generally parallel to the one or more support members;

one or more first guide members each having a base end and a remote end, wherein the one or more first guide members is each independently connected at or proximate to the base end of each of the one or more support members and extending generally perpendicular thereto, wherein the one or more first guide members each independently comprise one or more optional third connectors to receive and hold one of the one or more holes, wherein the one or more optional third connectors each extend through or are on the exterior surface of each of the one or more first guide members and generally parallel to the one or more support members;

one or more optional couplers for independently securing one of the one or more holes; and one or more optional second guide members each having a base end and a remote end, wherein each of the one or more optional second guide members is movably mounted on each of the one or more support members between the one or more first guide members and the remote end of each of the one or more support members and extending generally perpendicular thereto, wherein the one or more optional second guide members each independently comprise a first snap-fit device on the base end and an optional second snap-fit device on the remote end for independently receiving one of the one or more support members, wherein the one or more optional second guide members each comprise one or more fourth connectors for independently securing one of the one or more holes, wherein the one or more fourth connectors each extend through or are on the exterior surface of each of the one or more optional second guide members and generally parallel to the one or more support members, wherein the one or more optional second guide members each independently rest at a point of equilibrium intermediate the base end and the remote end of each of the one or more support members, wherein the one or more optional first connectors, the one or more second connectors, the one or more optional third connectors and the one or more fourth connectors each independently comprise a compressible pin, a non-compressible pin, a hook, a nut and a bolt, or a combination thereof.

The present invention provides a bi-directional tensioning apparatus. The bi-directional tensioning apparatus includes:

two resilient members each having a base end and a remote end, wherein the two resilient members each comprise a first elastic material with one or more holes along the length of each of the two resilient members;

two support members each having a base end and a remote end, wherein the two support members each comprise a first connector at each remote end for receiving and holding the one or more holes along the length of each of the two resilient members, wherein the first connectors at each remote end each extend through each of the two support members and generally parallel to the two support members;

a first guide member having a base end and a remote end, wherein the first guide member is connected at or proximate to the base end of each of the two support members and extending generally perpendicular thereto, wherein the first guide member includes two second connectors to receive and hold one of the one or more holes on each of the two resilient members, wherein the two second connectors each extend through the first guide member and are generally parallel to the two support members; and a second guide member having a base end and a remote end, wherein the second guide member is movably mounted on each of the two support members between the first guide member and the remote end of each of the two support members and extending generally perpendicular thereto, wherein the second guide member includes a first snap-fit device on the base end and a second snap-fit device on the remote end for independently receiving one of the two support members, wherein the second guide member includes two third connectors for independently securing one of the one or more holes, wherein the two third connectors each extend through each of the two second guide members and generally parallel to the two support members, wherein the second guide member independently rest at a point of equilibrium intermediate the base end and the remote end of each of the two support members wherein the two first connectors, the two second connectors, and the two third connectors each independently comprise a compressible pin, a non-compressible pin, a hook, a nut and a bolt, or a combination thereof.

The present invention provides a method for using a bi-directional tensioning apparatus. The method includes:

providing a bi-directional tensioning apparatus including: two resilient members each having a base end and a remote end, wherein the two resilient members each comprise a first elastic material with one or more holes along the length of each of the two resilient members;

two support members each having a base end and a remote end, wherein the two support members each comprise a first connector at each remote end for receiving and holding the one or more holes along the length of each of the two resilient members, wherein the first connectors at each remote end each extend through each of the two support members and generally parallel to the two support members;

a first guide member having a base end and a remote end, wherein the first guide member is connected at or proximate to the base end of each of the two support members and extending generally perpendicular thereto, wherein the first guide member includes two second connectors to receive and hold one of the one or more holes on each of the two resilient members, wherein the two second connectors each extend through the first guide member and are generally parallel to the two support members; and a second guide member having a base end and a remote end, wherein the second guide member is movably mounted on each of the two support members between the first guide member and the remote end of each of the two support members and extending generally perpendicular thereto, wherein the second guide member includes a first snap-fit device on the base end and a second snap-fit device on the remote end for independently receiving one of the two support members, wherein the second guide member includes two third connectors for independently securing one of the one or more holes, wherein the two third connectors each extend through each of the two second guide members and generally parallel to the two support members, wherein the second guide member independently rest at a point of equilibrium intermediate the base end and the remote end of each of the two support members wherein the two first connectors, the two second connectors, and the two third connectors each independently comprise a compressible pin, a non-compressible pin, a hook, a nut and a bolt, or a combination thereof;

displacing the second member; and engaging the one or more holes in the two third connectors to provide that the second guide member rests at a point of equilibrium intermediate the base end and the remote end of each of two elongate resilient members.

BRIEF DESCRIPTION OF THE DRAWINGS

Embodiments of the invention may be best understood by referring to the following description and accompanying drawings, which illustrate such embodiments. In the drawings.

Figure 1:
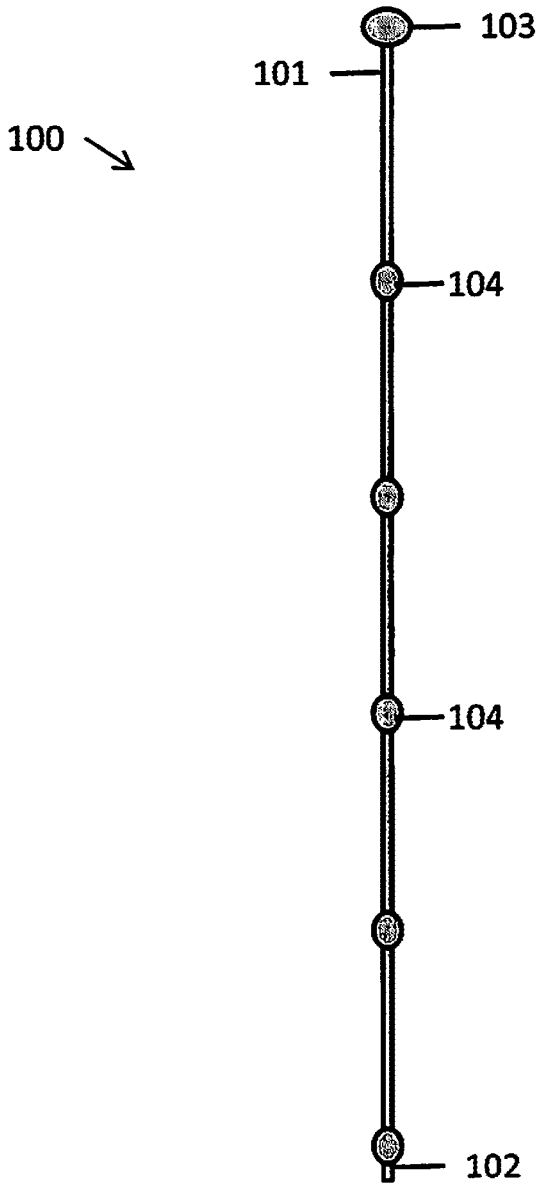
FIG. 1 is a front-view drawing illustrating an exemplary resilient member.

The drawings are not necessarily to scale. Like numbers used in the figures refer to like components, steps and the like. However, it will be understood that the use of a number to refer to a component in a given figure is not intended to limit the component in another figure labeled with the same number.

DETAILED DESCRIPTION OF THE INVENTION

The present invention provides a bi-directional tensioning apparatus that includes, for example, an elongate resilient member, a support member, a first guide member, and a second guide member. The bi-directional tensioning apparatus is able to hold the second guide member in an equilibrium position intermediate the base end and the remote end of the support member. When a force is applied to the second guide member, the bi-directional tensioning apparatus exerts an opposing force.

The unique structure of the bi-directional tensioning apparatus preserves the elongate resilient member strength and integrity by not squeezing, bending, or constricting the elongate resilient member during use. Therefore, no weak spots in the elongate resilient member are created by tearing, shearing, and abrading. The elongate resilient member includes, for example, enlargements, which are captured by the support member, the first guide member, and the second guide member to provide bi-directional tension.

The bi-directional tensioning apparatus as describe herein, find applications, for example, tie-down equipment, exercise equipment, physical rehabilitation equipment, portable scaffolding, and the like.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993, *The American Heritage Dictionary of the English Language*, Houghton Mifflin, Boston Mass., 1981, and *Hawley's Condensed Chemical Dictionary,* 14$^{th}$ edition, Wiley Europe, 2002.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

FIG. 1 is a front-view drawing illustrating an exemplary resilient member 100. The resilient member 100 having a base end 101 and a remote end 102. The resilient member 100 includes a first enlargement 103 at the base end and spaced-apart enlargements 104 along the length of the resilient member 100.

In one embodiment, the resilient member 100 may be made of for example, a styrene-butadiene rubber or a chloroprene (i.e., neoprene) rubber. The resilient member 100 has excellent memory characteristics and returns to its original shape after numerous elongations.

The resilient member 100 may also be made of any other suitable elastic material, for example, natural rubber, synthetic polyisoprene, butyl rubber (copolymer of isobutylene and isoprene), halogenated butyl rubber, polybutadiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 1000 to about 9000, and a percentage elongation to about 900. The elastic material should also possess, for example, good abrasion resistance, good tear resistance, and good ozone resistance.

In one embodiment, the exemplary resilient member 100 may be, for example, a bungee cord, which is an elastic cord composed of one or more elastic strands forming a core, usually covered in a woven nylon or cotton sheath.

In one embodiment, the first enlargement 103 at the base end and each of the one or more spaced-apart enlargements 104 is made of the elastic material. In one embodiment, the first enlargement 103 at the base end is made of the elastic material and each of the one or more spaced-apart enlargements 104 are made of a wooden material. In one embodiment, the first enlargement 103 at the base end is made of the elastic material and each of the one or more spaced-apart enlargements 104 are made of a metal material.

In one embodiment, the first enlargement 103 at the base end is made of the elastic material and each of the one or more spaced-apart enlargements 104 are made of a plastic material. In one embodiment, the first enlargement 103 at the base end is made of the elastic material and each of the one or more spaced-apart enlargements 104 are made of a different elastic material. In one embodiment, the first enlargement 103 at the base end is made of a wooden material and each of the one or more spaced-apart enlargements 104 are made of an elastic material.

In one embodiment, the first enlargement 103 at the base end is made of a wooden material and each of the one or more spaced-apart enlargements 104 are made of a wooden material. In one embodiment, the first enlargement 103 at the base end is made of a wooden material and each of the one or more spaced-apart enlargements 104 are made of a metal material. In one embodiment, the first enlargement 103 at the base end is made of a wooden material and each of the one or more spaced-apart enlargements 104 are made of a plastic material.

In one embodiment, the first enlargement 103 at the base end is made of a metal material and each of the one or more spaced-apart enlargements 104 are made of an elastic material. In one embodiment, the first enlargement 103 at the base end is made of a metal material and each of the one or more spaced-apart enlargements 104 are made of a wooden material. In one embodiment, the first enlargement 103 at the base end is made of a metal material and each of the one or more spaced-apart enlargements 104 are made of a metal material. In one embodiment, the first enlargement 103 at the base end is made of a metal material and each of the one or more spaced-apart enlargements 104 are made of a plastic material.

In one embodiment, the first enlargement 103 at the base end is made of a plastic material and each of the one or more spaced-apart enlargements 104 are made of an elastic material. In one embodiment, the first enlargement 103 at the base end is made of a plastic and each of the one or more spaced-apart enlargements 104 are made of a wooden material. In one embodiment, the first enlargement 103 at the base end is made of a plastic material and each of the one or more spaced-apart enlargements 104 are made of a metal material. In one embodiment, the first enlargement 103 at the base end is made of a plastic material and each of the one or more spaced-apart enlargements 104 are made of a plastic material.

In one embodiment, the first enlargement 103 at the base end and each of the one or more spaced-apart enlargements 104 is made of a knot of the elastic material. In one embodiment, the first enlargement 103 at the base end is made of elastic material and each of the one or more spaced-apart enlargements 104 is made of a knot of the elastic material. In one embodiment, the first enlargement 103 at the base end is made of a knot of the elastic material and each of the one or more spaced-apart enlargements 104 is made of the elastic material.

In one embodiment, the first enlargement 103 at the base end is made of knot of the elastic material and each of the one or more spaced-apart enlargements 104 are made of a wooden material. In one embodiment, the first enlargement 103 at the base end is made of wooden material and each of the one or more spaced-apart enlargements 104 are made of a knot of the elastic material.

In one embodiment, the first enlargement 103 at the base end is made of knot of the elastic material and each of the one or more spaced-apart enlargements 104 are made of a different elastic material. In one embodiment, the first enlargement 103 at the base end is made of a different elastic material and each of the one or more spaced-apart enlargements 104 are made of a knot of the elastic material.

In one embodiment, the first enlargement 103 at the base end is made of a metal material and each of the one or more spaced-apart enlargements 104 are made of a knot of the elastic material. In one embodiment, the first enlargement 103 at the base end is made of a knot of the elastic material and each of the one or more spaced-apart enlargements 104 are made of a metal material.

The first enlargement 103 may be, for example, of any shape that prevents the resilient member 100 from sliding through one of the first guide members described herein. The first enlargement 103 may be, for example, a cylindrical shape, a spherical shape, a square shape, a polygonal shape, and the like. Preferably, the first enlargement 103 has a cylindrical shape. More preferably, the first enlargement 103 has a cylindrical shape with a bevel edge on the side of the first enlargement 103 opposite the first guide member to provide reinforcement.

Figure 2:
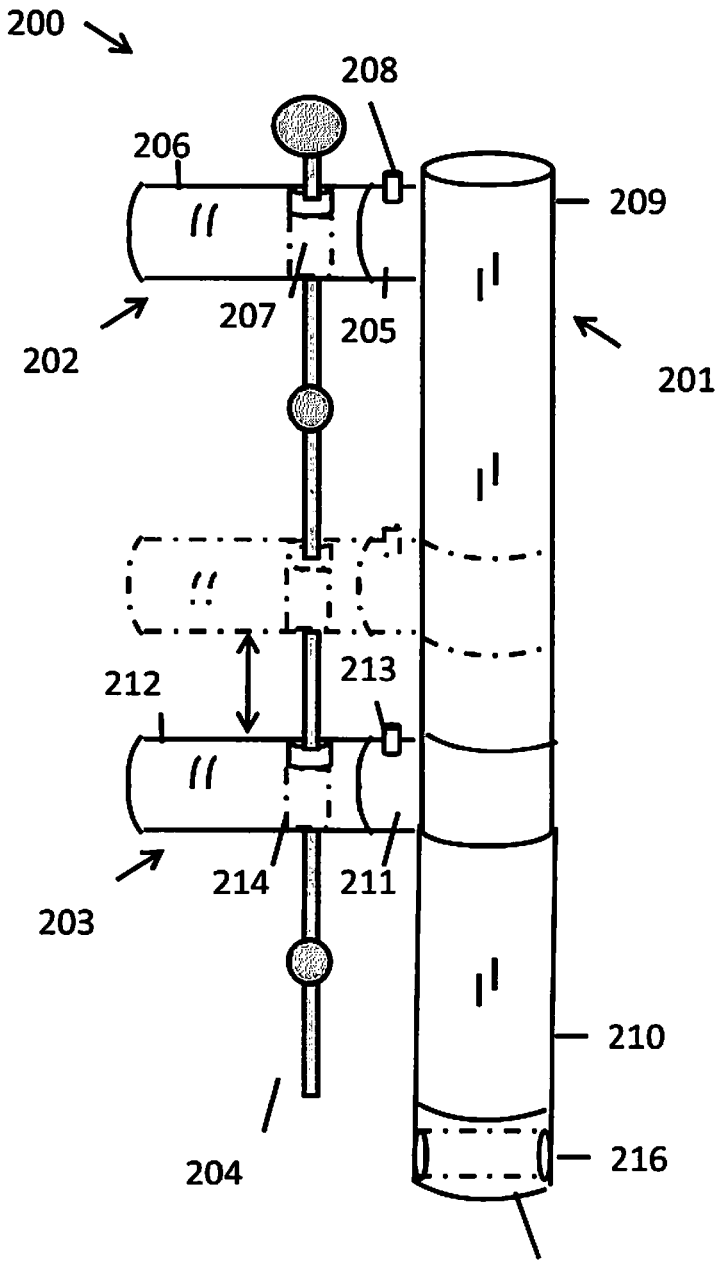
FIG. 2 is a perspective front-view drawing illustrating an exemplary bi-directional tensioning apparatus.

FIG. 2 is a perspective front-view drawing illustrating an exemplary bi-directional tensioning apparatus 200. The bi-directional tensioning apparatus 200 typically includes a support member 201, a first guide member 202, a second guide member 203, and elongate resilient member 204. The first guide member 202 includes a first coupler 205 and a first cylindrical tube 206. The first cylindrical tube 206 has an outside and an inside diameters equal to that the support member 201. The first cylindrical tube 206 also contains a first hole 207 extending perpendicular through the first cylindrical tube 206. When the first cylindrical tube 206 is attached to the first coupler 205, the first hole 207 is oriented in the direction parallel to the support member 201. The first hole 207 will allow the elongate resilient member 204 to pass through it up to the first enlargement.

The first hole 207 may be of any shape that can allow the remote end of the elongate resilient member 204 to pass through. In one embodiment, the elongate resilient member 204 has a circular cross section and the first hole 207 has a circular shape. In another embodiment, the elongate resilient member 204 has a polygonal cross section and the first hole 207 has the same polygonal shape.

In one embodiment, the first hole 207 has a surface recessed cavity (not shown) in a shape complementary to the shape of the first enlargement of the elongate resilient member 204 to form a tight fit under pressure.

In one embodiment, the first enlargement of the elongate resilient member 204 has a spherical shape and the recessed cavity (not shown) in the first hole 207 also has a complementary spherical shape. In one embodiment, the first enlargement of the elongate resilient member 204 has a cylindrical shape and the recessed cavity (not shown) in the first hole 207 also has a complementary cylindrical shape. In one embodiment, the first enlargement of the elongate resilient member 204 has a polygonal shape and the recessed cavity (not shown) in the first hole 207 also has a complementary polygonal shape.

One end of the first coupler 205 is rigidly secured to a base end of the support member 201, by adhesive or any other suitable means. A separate hole (not shown) is formed in the cylindrical sidewall of the first coupler 205, proximate the end of the support member 201. A corresponding hole (not shown) is formed through the cylindrical sidewall of the first cylindrical tube 206 proximate the end thereof. A snap button, of the type known in the art, is inserted into the corresponding hole (not shown) on one end of the first cylindrical tube 206, so that the first snap button 208 protrudes out of the hole. One end of the first cylindrical tube 206 is then inserted or "telescoped" into the first coupler 205 and arranged so that the first snap button 208 engages the hole through the sidewall thereof. In this manner, the first cylindrical tube 206 is releasably connected to the support member 201. The support member 201 extends linearly from its base end 209 to a remote end 210. The second guide member 203 includes the second coupler 211 and the second cylindrical tube 212. The second coupler 211 may be a snap-fit connector. An exemplary snap-fit connector is described herein below and shown in FIGS. 13-14.

The second cylindrical tube 212 has an outside and an inside diameter equal to that the support member 201. A corresponding hole (not shown) is formed through the cylindrical sidewall of the second cylindrical tube 212 proximate the end thereof. A snap button, of the type known in the art, is inserted into one end of the second cylindrical tube 212, so that the second snap button 213 protrudes out of the hole. One end of the second cylindrical tube 212 is then inserted or "telescoped" into the second coupler 211 and arranged so that the second snap button 213 engages the hole through the sidewall thereof. In this manner, the second cylindrical tube 212 is releasably connected to the support member 201. The second cylindrical tube 212 also contains a keyhole 214 also extending perpendicular through the second cylindrical tube 212. When the second cylindrical tube 212 is attached to the second coupler 211, the keyhole 214 is oriented in the direction parallel to the support member 201. The keyhole 214 will allow the first elongate resilient member 204 to pass through it and to engage one of the spaced-apart enlargements (not shown). Exemplary keyholes are described herein below and shown in FIG. 13.

A stop 215 is secured to the remote end 210 of the support member 201. The stop 215 contains a cavity 216 that captures and secures the elongate resilient member 204. The stop 215 may be secured to the support member 201 by a snap button (not shown) or any other suitable means.

In one embodiment, the second guide member 203 includes the second coupler 211 and the second cylindrical tube 212. In another embodiment, the second guide member 203 is a second cylindrical tube (not shown) with a coupler end.

A person can use the bi-directional tensioning apparatus 200 to perform a variety of exercises. The relative movement of the second guide member 203 toward or away from the first guide member 202, as indicated by the double arrow, increases the tension in the first elongate resilient member 204. For example, a person can perform a "fly" exercise by extending the hands generally forward, grasping the first guide member 202 in one hand, grasping the second guide member 203 in the other hand, and pressing the hands toward one another; a person can perform a "sitting knee curl" exercise by sitting on a chair, capturing the first guide member 202 between the floor and at least one foot, resting the elbows on the knees with the hands extending generally forward, grasping the second guide member 203 in opposite hands, and pulling upward and inward on the second guide member 203; a person can perform an "inner thigh squeeze" exercise by sitting on a chair, placing one knee against the outside of the first guide member 202, placing the other knee against the outside of the second guide member 203, and pressing the knees toward one another; and/or a person can perform an "outer thigh exercise by sitting on a chair, placing one knee against the inside of the first guide member 202, placing the other knee against the inside of the second guide member 203, and pressing the knees away from one another. When not in use, the exercise apparatus 200 may be collapsed, by removing the first cylindrical tube 206, the second cylindrical tube 212, and the elongate resilient member 204 to facilitate storage and/or transportation of the bi-directional tensioning apparatus 200. If adjustability of the amount of resistance is desired, the elongate resilient member 204 may be selectively moved relative to cavity 216.

Figure 3:
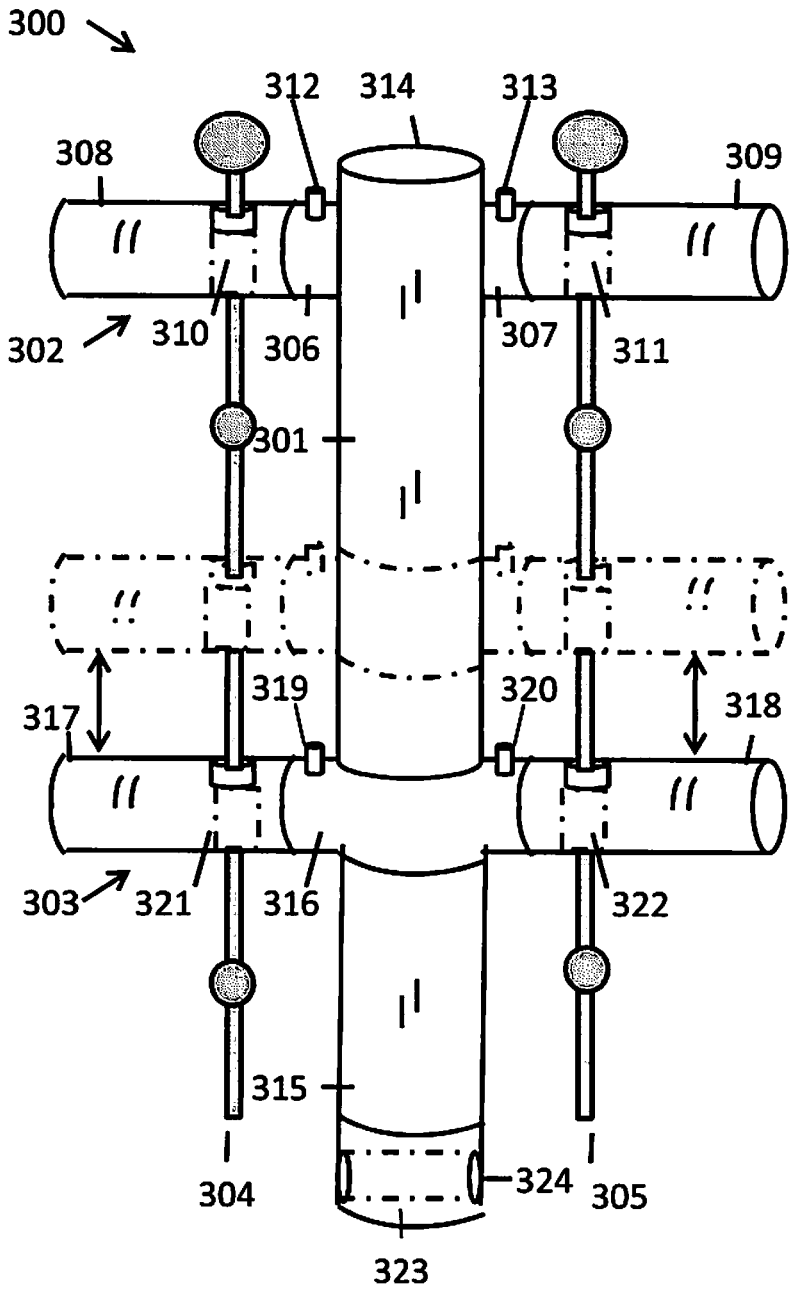
FIG. 3 is a perspective front-view drawing illustrating an exemplary bi-directional tensioning apparatus.

FIG. 3 is a perspective front-view drawing illustrating an exemplary bi-directional tensioning apparatus 300. The bi-directional tensioning apparatus 300 typically includes a support member 301, a first guide member 302, a second guide member 303, first elongate resilient member 304, and second elongate resilient member 305. The first guide member 302 includes a first coupler 306, a second coupler 307, a first cylindrical tube 308, and a second cylindrical tube 309. The first cylindrical tube 308 and the second cylindrical tube 309 have outside and inside diameters equal to that the support member 301. The first cylindrical tube 308 also contains a first hole 310 extending perpendicular through the first cylindrical tube 308. The second cylindrical tube 309 also contains a second hole 311 also extending perpendicular through the second cylindrical tube 309. When the first cylindrical tube 308 and the second cylindrical tube 309 are attached to the first coupler 306 and the second coupler 307, respectively, the first hole 310 and the second hole 311 are oriented in the direction parallel to the support member 301. The first hole 310 will allow the first elongate resilient member 304 to pass through it up to the first enlargement. The second hole 311 will allow the second elongate resilient member 305 to pass through it up to the first enlargement.

One end of the first coupler 306 is rigidly secured to a base end of the support member 301, by adhesive or any other suitable means. One end of the second coupler 307 is rigidly secured to a base end of the support member 301, by adhesive or any other suitable means. A separate hole (not shown) is formed in the cylindrical sidewall of each of the couplers 306 and 307, proximate the end of the support member 301. Corresponding holes (not shown) are formed through the cylindrical sidewall of the first cylindrical tube 308 and the second cylindrical tube 309 proximate each end thereof. Snap buttons, of the type known in the art, are inserted into the corresponding hole (not shown) on one end of the first cylindrical tube 308 and into the corresponding hole (not shown) on one end of the second cylindrical tube 309, so that the first snap button 312 and the second snap button 313 each protrude out of their respective holes. One end of the first cylindrical tube 308 is then inserted or "telescoped" into the first coupler 306 and arranged so that the first snap button 312 engages the hole through the sidewall thereof. One end of the second cylindrical tube 309 is then inserted or "telescoped" into the second coupler 307 and arranged so that the second snap button 313 engages the hole through the sidewall thereof. In this manner, the first cylindrical tube 308 and the second cylindrical tube 309 are releasably connected to the support member 301. The support member 301 extends linearly from its base end 314 to a remote end 315. The second guide member 303 includes the four-way coupler 316, a third cylindrical tube 317, and a fourth cylindrical tube 318. The third cylindrical tube 317 and the fourth cylindrical tube 318 have outside and inside diameters equal to that the support member 301. Corresponding holes are formed through the cylindrical sidewall of the third cylindrical tube 317 and the fourth cylindrical tube 318 proximate each end thereof. Snap buttons, of the type known in the art, are inserted into one end of the third cylindrical tube 317 and one end of the fourth cylindrical tube 318, so that the third snap button 319 and the fourth snap button 320 each protrude out of their respective holes. One end of the third cylindrical tube 317 is then inserted or "telescoped" into the four-way coupler 316 and arranged so that the third snap button 319 engages the hole through the sidewall thereof. One end of the fourth cylindrical tube 318 is then inserted or "telescoped" into the opposite side of the four-way coupler 316 and arranged so that the fourth snap button 320 engages the hole through the sidewall thereof. In this manner, the third cylindrical tube 317 and the fourth cylindrical tube 318 are releasably connected to the support member 301. The third cylindrical tube 317 also contains a first keyhole 321 extending perpendicular through the third cylindrical tube 317. The fourth cylindrical tube 318 also contains a second keyhole 322 also extending perpendicular through the fourth cylindrical tube 318. When the third cylindrical tube 317 and the fourth cylindrical tube 318 are attached to the four-way coupler 316, respectively, the first keyhole 321 and the second keyhole 322 are oriented in the direction parallel to the support member 301. The first keyhole 321 will allow the first elongate resilient member 304 to pass through it and to engage one of the spaced-apart enlargements (not shown). The second keyhole 322 will allow the second elongate resilient member 305 to pass through it and to engage one of the spaced-apart enlargements (not shown). Exemplary keyholes are described herein below and shown in FIG. 13.

The first hole 310 may be of any shape that can allow the remote end of the first elongate resilient member 304 to pass through. In one embodiment, the first elongate resilient member 304 has a circular cross section and the first hole 310 has a circular shape. In another embodiment, the first elongate resilient member 304 has a polygonal cross section and the first hole 310 has the same polygonal shape.

In one embodiment, the first hole 310 has a surface recessed cavity (not shown) in a shape complementary to the shape of the first enlargement of the first elongate resilient member 304 to form a tight fit under pressure.

In one embodiment, the first enlargement of the first elongate resilient member 304 has a spherical shape and the recessed cavity (not shown) in the first hole 310 also has a complementary spherical shape. In one embodiment, the first enlargement of the first elongate resilient member 304 has a cylindrical shape and the recessed cavity (not shown) in the first hole 310 also has a complementary cylindrical shape. In one embodiment, the first enlargement of the first elongate resilient member 304 has a polygonal shape and the recessed cavity (not shown) in the first hole 310 also has a complementary polygonal shape.

The second hole 311 may be of any shape that can allow the remote end of the second elongate resilient member 305 to pass through. In one embodiment, the second elongate resilient member 305 has a circular cross section and the second hole 311 has a circular shape. In another embodiment, the second elongate resilient member 305 has a polygonal cross section and the second hole 311 has the same polygonal shape.

In one embodiment, the second hole 311 has a surface recessed cavity (not shown) in a shape complementary to the shape of the first enlargement of the second elongate resilient member 305 to form a tight fit under pressure.

In one embodiment, the first enlargement of the second elongate resilient member 305 has a spherical shape and the recessed cavity (not shown) in the second hole 311 also has a complementary spherical shape. In one embodiment, the first enlargement of the second elongate resilient member 305 has a cylindrical shape and the recessed cavity (not shown) in the second hole 311 also has a complementary cylindrical shape. In one embodiment, the first enlargement of the second elongate resilient member 305 has a polygonal shape and the recessed cavity (not shown) in the second hole 311 also has a complementary polygonal shape.

A stop 323 is secured to the remote end 315 of the support member 301. The stop 323 contains a cavity 324 that captures and secures both the first elongate resilient member 304 and the second elongate resilient member 305. The stop 323 may be secured to the support member 301 by a snap button (not shown) or any other suitable means. In another embodiment, the stop 323 contains two cavities that each independently captures and secures both the first elongate resilient member 304 and the second elongate resilient member 305.

The relative movement of the second guide member 303 toward or away from the first guide member 302, as indicated by the double arrows, increases the tension in the first elongate resilient member 304 and the second elongate resilient member 305.

Figure 4:
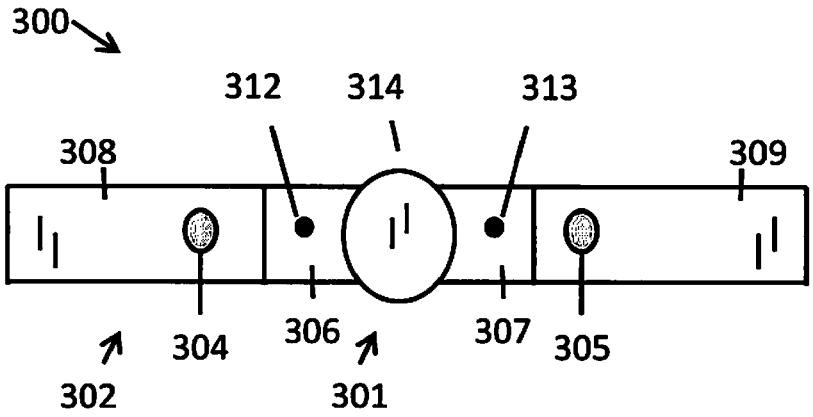
FIG. 4 is a top-view drawing illustrating an exemplary bi-directional tensioning apparatus.

FIG. 4 is a top-view drawing illustrating an exemplary bi-directional tensioning apparatus 300. The bi-directional tensioning apparatus 300 typically includes a support member 301, a first guide member 302, first elongate resilient member 304, and second elongate resilient member 305. The first guide member 302 includes the first coupler 306, the second coupler 307, the first cylindrical tube 308, the second cylindrical tube 309, the first snap button 312, and the second snap button 313.

Figure 5:
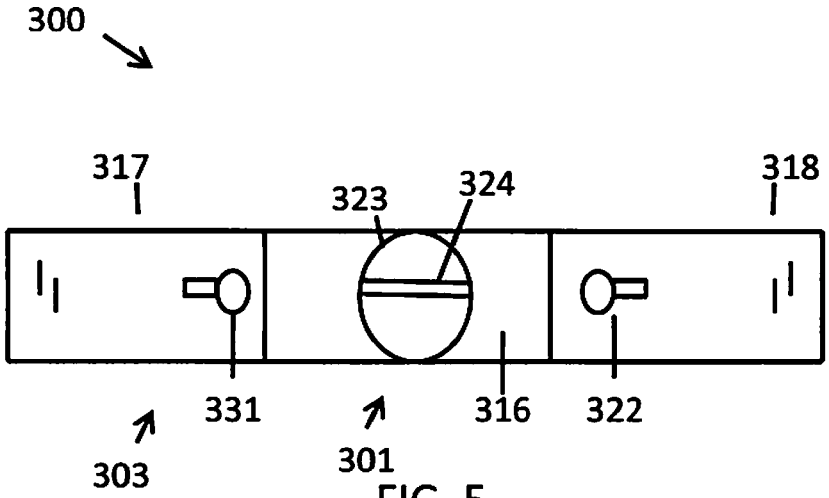
FIG. 5 is a bottom-view drawing illustrating an exemplary bi-directional tensioning apparatus.

FIG. 5 is a bottom-view drawing illustrating an exemplary bi-directional tensioning apparatus 300. The bi-directional tensioning apparatus 300 typically includes a support member 301, and the second guide member 303. The second guide member 303 includes the four-way coupler 316, a third cylindrical tube 317, a fourth cylindrical tube 318, the first keyhole 321 and the second keyhole 322. The bottom or remote end of the support member 301 includes the stop 323, which contains the cavity 324.

Those skilled in the art will also recognize that bi-directional tensioning apparatus 300 may also be used with the first elongate resilient member 304 or with the second elongate resilient member 305, or with more than two elongate resilient members to facilitate additional bi-directional tensioning and/or resistance curves.

A person can use the bi-directional tensioning apparatus 300 to perform a variety of exercises. For example, a person can perform a "chest press" exercise by placing the base end 314 of the support member 301 on their chest, extending the hands generally forward, grasping the second guide member 303 in opposite hands, and pressing outward with the arms; a person can perform a "fly" exercise by extending the hands generally forward, grasping the first guide member 302 in one hand, grasping the second guide member 303 in the other hand, and pressing the hands toward one another; a person can perform a "sitting knee curl" exercise by sitting on a chair, capturing the first guide member 302 between the floor and at least one foot, resting the elbows on the knees with the hands extending generally forward, grasping the second guide member 303 in opposite hands, and pulling upward and inward on the second guide member 303; a person can perform a "standing curl" exercise by placing the first guide member 302 behind the buttocks, extending the hands generally downward, grasping the second guide member 303 in opposite hands in opposite hands, and pulling upward and inward on the second guide member 303; a person can perform a "military press" exercise by placing the first guide member 302 behind the head and across the shoulders, extending the hands generally above the head, grasping the second guide member 303 in opposite hands, and pulling downward on the second guide member 303; a person can perform a "squat" exercise by placing the first guide member 302 on the floor, standing on the first guide member 302, extending the hands generally downward, grasping the second guide member 303 in opposite hands, and pulling upward on the second guide member 303; a person can perform a "sit up" exercise by sitting on a chair, placing the first guide member 302 across the lap, capturing the second guide member 303 beneath the arms, and pushing downward on the second guide member 303; a person can perform an "inner thigh squeeze" exercise by sitting on a chair, placing one knee against the outside of the first guide member 302, placing the other knee against the outside of the second guide member 303, and pressing the knees toward one another; and/or a person can perform an "outer thigh exercise by sitting on a chair, placing one knee against the inside of the first guide member 302, placing the other knee against the inside of the second guide member 303, and pressing the knees away from one another. When not in use, the exercise apparatus 300 may be collapsed, by removing the first cylindrical tube 308, the second cylindrical tube 309, the third cylindrical tube 317, the fourth cylindrical tube 318, the first elongate resilient member 304, and the second elongate resilient member 305 to facilitate storage and/or transportation of the bi-directional tensioning apparatus 300. If adjustability of the amount of resistance is desired, the first elongate resilient member 304 and the second elongate resilient member 305 may be selectively moved relative cavity 324.

Figure 6:
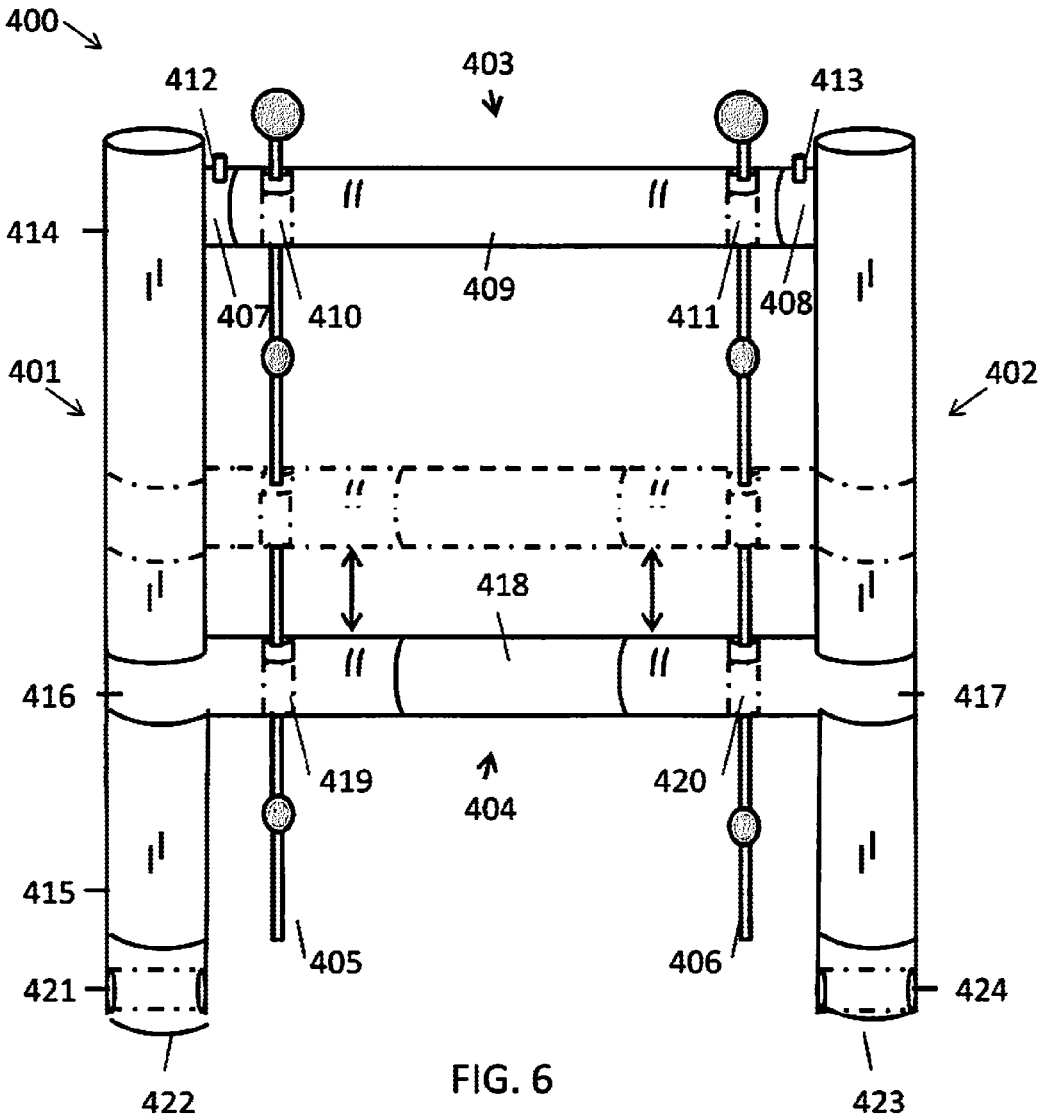
FIG. 6 is a perspective front-view drawing illustrating an exemplary bi-directional tensioning apparatus.

FIG. 6 is a perspective front-view drawing illustrating an exemplary bi-directional tensioning apparatus 400. The bi-directional tensioning apparatus 400 typically includes a first support member 401, a second support member 402, a first guide member 403, a second guide member 404, a first elongate resilient member 405, and a second elongate resilient member 406. The first guide member 403 includes a first coupler 407, a second coupler 408, and a first cylindrical tube 409. The first cylindrical tube 409 has an outside and an inside diameter equal to that the first support member 401. The first cylindrical tube 409 also contains a first hole 410 and a second hole 411 both extending perpendicular through the first cylindrical tube 409. When the first cylindrical tube 409 is attached to the first coupler 407 and the second coupler 408, the first hole 410 and the second hole 411 are oriented in the direction parallel to the first support member 401 and the second support member 402. The first hole 410 will allow the first elongate resilient member 405 to pass through it up to the first enlargement. The second hole 411 will allow the second elongate resilient member 406 to pass through it up to the first enlargement.

One end of the first coupler 407 is rigidly secured to a base end of the first support member 401, by adhesive or any other suitable means. One end of the second coupler 408 is rigidly secured to a base end of the second support member 402, by adhesive or any other suitable means. A separate hole is formed in the cylindrical sidewall of each of the first coupler 407 and the second coupler 408, proximate the end of the first support member 401 and the second support member 402, respectively. Corresponding holes (not shown) are formed through the cylindrical sidewall of the first cylindrical tube 409 proximate the opposite ends thereof. Snap buttons, of the type known in the art, are inserted into the corresponding hole (not shown) on opposite ends of the first cylindrical tube 409, so that the first snap button 412 and the second snap button 413 each protrude out of their respective holes. One end of the first cylindrical tube 409 is then inserted or "telescoped" into the first coupler 407 and arranged so that the first snap button 412 engages the hole through the sidewall thereof. The opposite end of the first cylindrical tube 409 then inserted or "telescoped" into the second coupler 408 and arranged so that the second snap button 413 engages the hole through the sidewall thereof. In this manner, the first cylindrical tube 409 is releasably connected to the first support member 401 and the second support member 402. The first support member 401 extends linearly from its base end 414 to a remote end 415.

The second guide member 404 includes a first snap-fit connector 416, a second snap-fit connector 417, and a second cylindrical tube 418. An exemplary snap-fit connector is described herein below and shown in FIGS. 13-14. The second cylindrical tube 418 has outside and inside diameter equals to that the first support member 401 and the second support member 402.

The first snap-fit connector 416 also contains a first keyhole 419 extending perpendicular through the first snap-fit connector 416. The second snap-fit connector 417 also contains a second keyhole 420 also extending perpendicular through the second snap-fit connector 417. When the second cylindrical tube 418 is attached to both of the first snap-fit connector 416 and the second snap-fit connector 417, the first keyhole 419 and the second keyhole 420 are oriented in the direction parallel to the first support member 401 and the second support member 402. The first keyhole 419 will allow the first elongate resilient member 405 to pass through it and to engage one of the spaced-apart enlargements (not shown). The second keyhole 420 will allow the second elongate resilient member 406 to pass through it and to engage one of the spaced-apart enlargements (not shown). Exemplary keyholes are described herein below and shown in FIG. 13.

The first hole 410 may be of any shape that can allow the remote end of the first elongate resilient member 405 to pass through. In one embodiment, the first elongate resilient member 405 has a circular cross section and the first hole 410 has a circular shape. In another embodiment, the first elongate resilient member 405 has a polygonal cross section and the first hole 410 has the same polygonal shape.

In one embodiment, the first hole 410 has a surface recessed cavity (not shown) in a shape complementary to the shape of the first enlargement of the first elongate resilient member 405 to form a tight fit under pressure.

In one embodiment, the first enlargement of the first elongate resilient member 405 has a spherical shape and the recessed cavity (not shown) in the first hole 410 also has a complementary spherical shape. In one embodiment, the first enlargement of the first elongate resilient member 405 has a cylindrical shape and the recessed cavity (not shown) in the first hole 410 also has a complementary cylindrical shape. In one embodiment, the first enlargement of the first elongate resilient member 405 has a polygonal shape and the recessed cavity (not shown) in the first hole 410 also has a complementary polygonal shape.

The second hole 411 may be of any shape that can allow the remote end of the second elongate resilient member 406 to pass through. In one embodiment, the second elongate resilient member 406 has a circular cross section and the second hole 411 has a circular shape. In another embodiment, the second elongate resilient member 406 has a polygonal cross section and the second hole 411 has the same polygonal shape.

In one embodiment, the second hole 411 has a surface recessed cavity (not shown) in a shape complementary to the shape of the first enlargement of the second elongate resilient member 406 to form a tight fit under pressure.

In one embodiment, the first enlargement of the second elongate resilient member 406 has a spherical shape and the recessed cavity (not shown) in the second hole 411 also has a complementary spherical shape. In one embodiment, the first enlargement of the elongate resilient member 406 has a cylindrical shape and the recessed cavity (not shown) in the second hole 411 also has a complementary cylindrical shape. In one embodiment, the first enlargement of the elongate resilient member 406 has a polygonal shape and the recessed cavity (not shown) in the second hole 411 also has a complementary polygonal shape.

A first stop 421 is secured to the remote end 415 of the first support member 401. The first stop 421 contains a first cavity 422 that captures and secures and the first elongate resilient member 405. The first stop 421 may be secured to the first support member 401 by a snap button (not shown) or any other suitable means.

A second stop 423 is secured to the remote end of the second support member 402. The second stop 423 contains a second cavity 424 that captures and secures and the second elongate resilient member 406. The second stop 423 may be secured to the second support member 402 by a snap button (not shown) or any other suitable means.

Those skilled in the art will also recognize that bi-directional tensioning apparatus 400 may also be used with the first elongate resilient member 405 or with the second elongate resilient member 406, or with more than two elongate resilient members to facilitate additional bi-directional tensioning and/or resistance curves.

Figure 7:
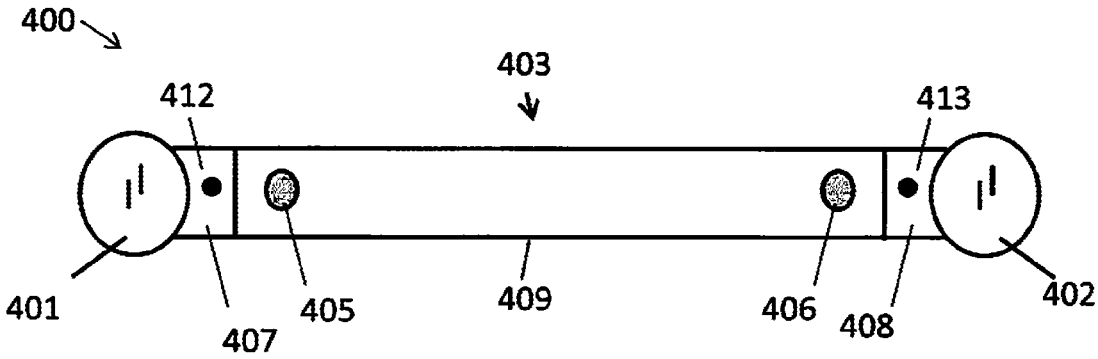
FIG. 7 is a top-view drawing illustrating an exemplary bi-directional tensioning apparatus.

FIG. 7 is a top-view drawing illustrating an exemplary bi-directional tensioning apparatus 400. The bi-directional tensioning apparatus 400 typically includes the first support member 401, the second support member 402, and the first guide member 403, the first elongate resilient member 405, and the second elongate resilient member 406. The first guide member 403 includes the first coupler 407, the second coupler 408, the first cylindrical tube 409, the first snap button 412, and the second snap button 413.

Figure 8:
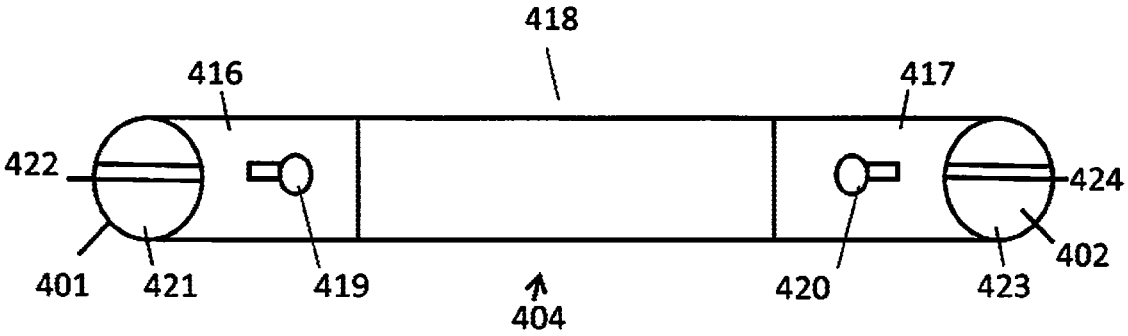
FIG. 8 is a bottom-view drawing illustrating an exemplary portable structure.

FIG. 8 is a bottom-view drawing illustrating an exemplary bi-directional tensioning apparatus 400. The bi-directional tensioning apparatus 400 typically includes the first support member 401, the second support member 402, and the second guide member 404. The second guide member 404 includes the first snap-fit connector 416, the second snap-fit connector 417, the second cylindrical tube 418, the first keyhole 419, and the second keyhole 420. The bottom or remote end of the first support member 401 includes the first stop 421, which contains the first cavity 422. The bottom or remote end of the second support member 402 includes the second stop 423, which contains the second cavity 424.

The relative movement of the second guide member 404 toward or away from the first guide member 403, as indicated by the double arrows, increases the tension in the first elongate resilient member 405 and the second elongate resilient member 406.

A person can use the bi-directional tensioning apparatus 400 to perform a variety of exercises. For example, a person can perform a "chest press" exercise by placing the first guide member 403 on their chest, extending the hands generally forward, grasping the second guide member 404 in opposite hands, and pressing outward with the arms; a person can perform a "fly" exercise by extending the hands generally forward, grasping the first guide member 403 in one hand, grasping the second guide member 404 in the other hand, and pressing the hands toward one another; a person can perform a "sitting knee curl" exercise by sitting on a chair, capturing the first guide member 403 between the floor and at least one foot, resting the elbows on the knees with the hands extending generally forward, grasping the second guide member 404 with opposite hands, and pulling upward and inward on the second guide member 404; a person can perform a "standing curl" exercise by placing the first guide member 403 behind the buttocks, extending the hands generally downward, grasping the second guide member 404 in opposite hands, and pulling upward and inward on the second guide member 404; a person can perform a "military press" exercise by placing the first guide member 403 behind the head and across the shoulders, extending the hands generally above the head, grasping the second guide member 404 with opposite hands, and pulling downward on the second guide member 404; a person can perform a "squat" exercise by placing the first guide member 403 on the floor, standing on the first guide member 403, extending the hands generally downward, grasping the second guide member 404 in opposite hands, and pulling upward on the second guide member 404; a person can perform a "sit up" exercise by sitting on a chair, placing the first guide member 403 across the lap, capturing the second guide member 404 beneath the arms, and pushing downward on the second guide member 404; a person can perform an "inner thigh squeeze" exercise by sitting on a chair, placing one knee against the outside of the first support member 401, placing the other knee against the outside of the second support member 402, and pressing the knees toward one another; and/or a person can perform an "outer thigh exercise by sitting on a chair, placing one knee against the inside of the first guide member 403, placing the other knee against the inside of the second guide member 404, and pressing the knees away from one another. When not in use, the bi-directional tensioning apparatus 400 may be collapsed, by removing the first guide member 403, the second guide member 404, the first elongate resilient member 405, and the second elongate resilient member 406 to facilitate storage and/or transportation of the bi-directional tensioning apparatus 400. If adjustability of the amount of resistance is desired, the first elongate resilient member 405 and the second elongate resilient member 406 may be selectively moved relative each cavity 422 and 424, respectively.

Figure 9:
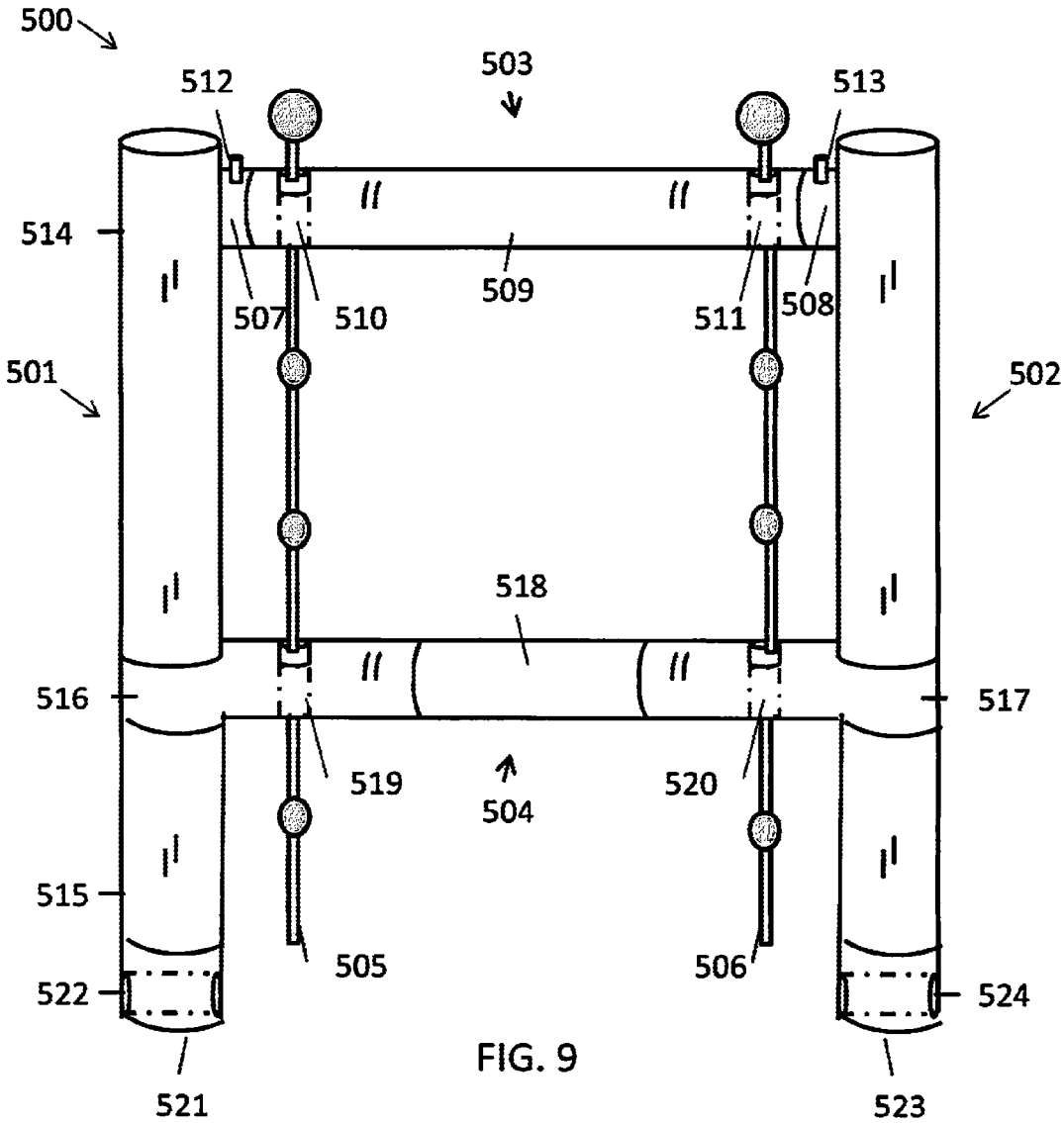
FIG. 9 is a perspective front-view drawing illustrating an exemplary portable structure.

FIG. 9 is a perspective front-view drawing illustrating an exemplary portable structure 500 that may be made using the bi-directional tensioning apparatus described herein. The portable structure 500 typically includes a first support member 501, a second support member 502, a first guide member 503, a second guide member 504, a first elongate resilient member 505, and a second elongate resilient member 506. The first guide member 503 includes a first coupler 507, a second coupler 508, and a first cylindrical tube 509. The first cylindrical tube 509 has an outside and an inside diameter equal to that the first support member 501. The first cylindrical tube 509 also contains a first hole 510 and a second hole 511 both extending perpendicular through the first cylindrical tube 509. When the first cylindrical tube 509 is attached to the first coupler 507 and the second coupler 508, the first hole 510 and the second hole 511 are oriented in the direction parallel to the first support member 501 and the second support member 502. The first hole 510 will allow the first elongate resilient member 505 to pass through it up to the first enlargement. The second hole 511 will allow the second elongate resilient member 506 to pass through it up to the first enlargement.

One end of the first coupler 507 is rigidly secured to a base end of the first support member 501, by adhesive or any other suitable means. One end of the second coupler 508 is rigidly secured to a base end of the second support member 502, by adhesive or any other suitable means. A separate hole is formed in the cylindrical sidewall of each of the first coupler 507 and the second coupler 508, proximate the end of the first support member 501 and the second support member 502, respectively. Corresponding holes (not shown) are formed through the cylindrical sidewall of the first cylindrical tube 509 proximate the opposite ends thereof. Snap buttons, of the type known in the art, are inserted into the corresponding hole (not shown) on opposite ends of the first cylindrical tube 509, so that the first snap button 512 and the second snap button 513 each protrude out of their respective holes. One end of the first cylindrical tube 509 is then inserted or "telescoped" into the first coupler 507 and arranged so that the first snap button 512 engages the hole through the sidewall thereof. The opposite end of the first cylindrical tube 509 then inserted or "telescoped" into the second coupler 508 and arranged so that the second snap button 513 engages the hole through the sidewall thereof. In this manner, the first cylindrical tube 509 is releasably connected to the first support member 501 and the second support member 502. The first support member 501 extends linearly from its base end 514 to a remote end 515.

The second guide member 504 includes a first snap-fit connector 516, a second snap-fit connector 517, and a second cylindrical tube 518. An exemplary snap-fit connector is described herein below and shown in FIGS. 13-14. The second cylindrical tube 518 has outside and inside diameter equals to that the first support member 501 and the second support member 502.

The first snap-fit connector 516 also contains a first keyhole 519 extending perpendicular through the first snap-fit connector 516. The second snap-fit connector 517 also contains a second keyhole 520 also extending perpendicular through the second snap-fit connector 517. When the second cylindrical tube 518 is attached to both of the first snap-fit connector 516 and the second snap-fit connector 517, the first keyhole 519 and the second keyhole 520 are oriented in the direction parallel to the first support member 501 and the second support member 502. The first keyhole 519 will allow the first elongate resilient member 505 to pass through it and to engage one of the spaced-apart enlargements (not shown). The second keyhole 520 will allow the second elongate resilient member 506 to pass through it and to engage one of the spaced-apart enlargements (not shown). Exemplary keyholes are described herein below and shown in FIG. 13.

The first hole 510 may be of any shape that can allow the remote end of the first elongate resilient member 505 to pass through. In one embodiment, the first elongate resilient member 505 has a circular cross section and the first hole 510 has a circular shape. In another embodiment, the first elongate resilient member 505 has a polygonal cross section and the first hole 510 has the same polygonal shape.

In one embodiment, the first hole 510 has a surface recessed cavity (not shown) in a shape complementary to the shape of the first enlargement of the first elongate resilient member 505 to form a tight fit under pressure.

In one embodiment, the first enlargement of the first elongate resilient member 505 has a spherical shape and the recessed cavity (not shown) in the first hole 510 also has a complementary spherical shape. In one embodiment, the first enlargement of the first elongate resilient member 505 has a cylindrical shape and the recessed cavity (not shown) in the first hole 510 also has a complementary cylindrical shape. In one embodiment, the first enlargement of the first elongate resilient member 505 has a polygonal shape and the recessed cavity (not shown) in the first hole 510 also has a complementary polygonal shape.

The second hole 511 may be of any shape that can allow the remote end of the second elongate resilient member 506 to pass through. In one embodiment, the second elongate resilient member 506 has a circular cross section and the second hole 511 has a circular shape. In another embodiment, the second elongate resilient member 506 has a polygonal cross section and the second hole 511 has the same polygonal shape.

In one embodiment, the second hole 511 has a surface recessed cavity (not shown) in a shape complementary to the shape of the first enlargement of the second elongate resilient member 506 to form a tight fit under pressure.

In one embodiment, the first enlargement of the second elongate resilient member 506 has a spherical shape and the recessed cavity (not shown) in the second hole 511 also has a complementary spherical shape. In one embodiment, the first enlargement of the second elongate resilient member 506 has a cylindrical shape and the recessed cavity (not shown) in the second hole 511 also has a complementary cylindrical shape. In one embodiment, the first enlargement of the second elongate resilient member 506 has a polygonal shape and the recessed cavity (not shown) in the second hole 511 also has a complementary polygonal shape.

A first stop 521 is secured to the remote end 515 of the first support member 501. The first stop 521 contains a first cavity 522 that captures and secures and the first elongate resilient member 505. The first stop 521 may be secured to the first support member 501 by a snap button (not shown) or any other suitable means.

A second stop 523 is secured to the remote end of the second support member 502. The second stop 523 contains a second cavity 524 that captures and secures and the second elongate resilient member 506. The second stop 523 may be secured to the second support member 502 by a snap button (not shown) or any other suitable means.

Figure 10:
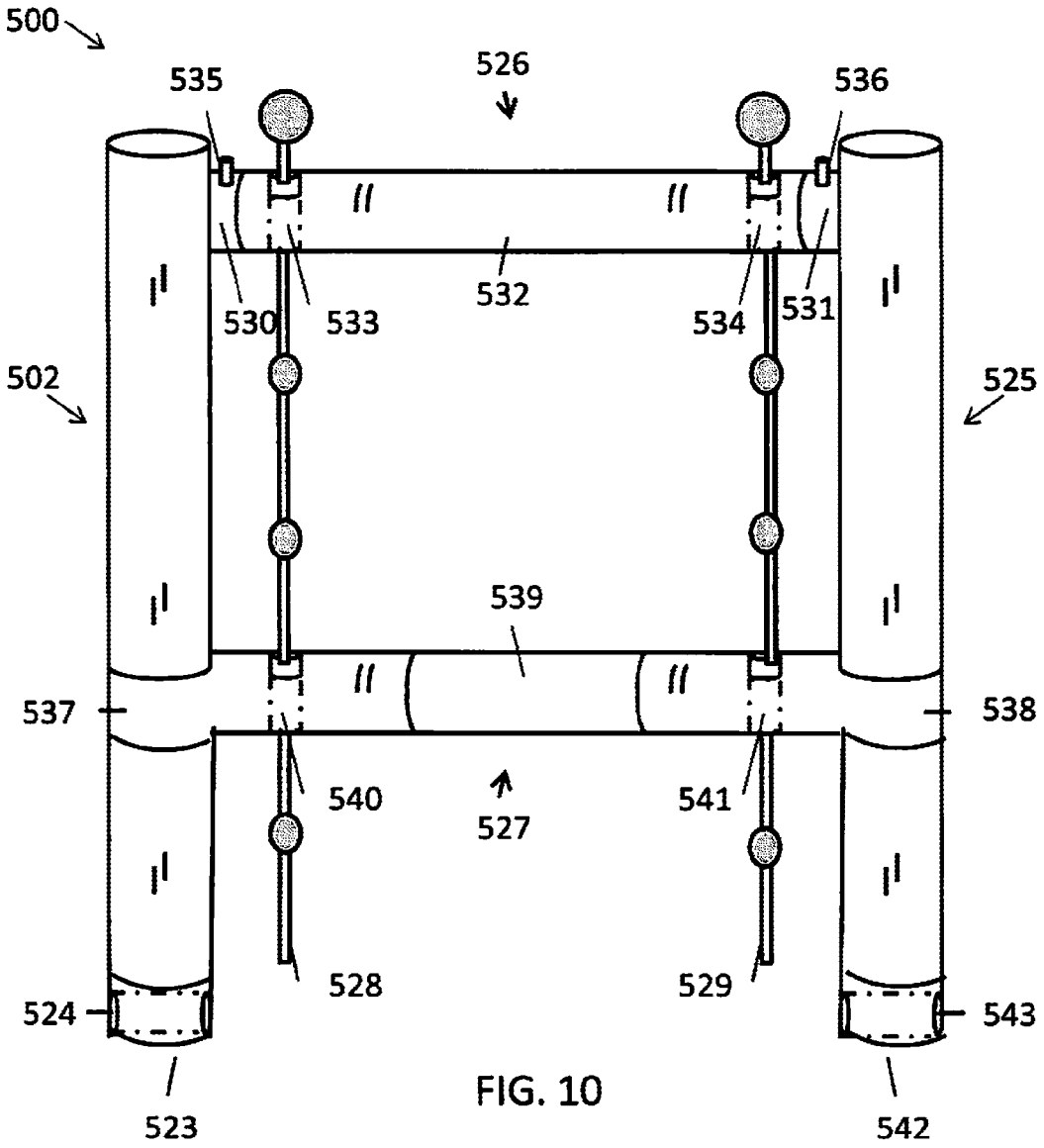
FIG. 10 is a perspective right-side view illustrating an exemplary portable structure.

FIG. 10 is a perspective right-view drawing illustrating an exemplary portable structure 500 that may be made using the bi-directional tensioning apparatus described herein. The right side of the portable structure 500 typically includes the second support member 502, the third support member 525, a third guide member 526, a fourth guide member 527, a third elongate resilient member 528, and a fourth elongate resilient member 529. The third guide member 526 includes a third coupler 530, a fourth coupler 531, and a third cylindrical tube 532. The third cylindrical tube 532 has an outside and an inside diameter equal to that the first support member 501. The third cylindrical tube 532 also contains a third hole 533 and a fourth hole 534 both extending perpendicular through the third cylindrical tube 532. When the third cylindrical tube 532 is attached to the third coupler 530 and the fourth coupler 531, the third hole 533 and the fourth hole 534 are oriented in the direction parallel to the second support member 502. The third hole 533 will allow the third elongate resilient member 528 to pass through it up to the first enlargement. The fourth hole 534 will allow the fourth elongate resilient member 529 to pass through it up to the first enlargement.

One end of the third coupler 530 is rigidly secured to a base end of the second support member 502, by adhesive or any other suitable means. One end of the fourth coupler 531 is rigidly secured to a base end of the third support member 525, by adhesive or any other suitable means. A separate hole is formed in the cylindrical sidewall of each of the third coupler 530 and the fourth coupler 531, proximate the end of the second support member 502 and the third support member 525, respectively. Corresponding holes (not shown) are formed through the cylindrical sidewall of the third cylindrical tube 532 proximate the opposite ends thereof. Snap buttons, of the type known in the art, are inserted into the corresponding hole (not shown) on opposite ends of the third cylindrical tube 532, so that the third snap button 535 and the fourth snap button 536 each protrude out of their respective holes. One end of the third cylindrical tube 532 is then inserted or "telescoped" into the third coupler 530 and arranged so that the third snap button 535 engages the hole through the sidewall thereof. The opposite end of the third cylindrical tube 532 then inserted or "telescoped" into the fourth coupler 531 and arranged so that the fourth snap button 536 engages the hole through the sidewall thereof. In this manner, the third cylindrical tube 532 is releasably connected to the second support member 502 and the third support member 525.

The fourth guide member 527 includes a third snap-fit connector 537, a fourth snap-fit connector 538, and a fourth cylindrical tube 539. An exemplary snap-fit connector is described herein below and shown in FIGS. 13-14. The fourth cylindrical tube 539 has outside and inside diameter equals to that the first support member 501 and the second support member 502.

The third snap-fit connector 537 also contains a third keyhole 540 extending perpendicular through the third snap-fit connector 537. The fourth snap-fit connector 538 also contains a fourth keyhole 541 also extending perpendicular through the fourth snap-fit connector 538. When the fourth cylindrical tube 539 is attached to each of the third snap-fit connector 537 and the fourth snap-fit connector 538, the third keyhole 540 and the fourth keyhole 541 are oriented in the direction parallel to the second support member 502. The third keyhole 540 will allow the third elongate resilient member 528 to pass through it and to engage one of the spaced-apart enlargements (not shown). The fourth keyhole 541 will allow the fourth elongate resilient member 529 to pass through it and to engage one of the spaced-apart enlargements (not shown). Exemplary keyholes are described herein below and shown in FIG. 13.

The third snap-fit connector 537 typically fits on the second support member 502 adjacent to the second snap-fit connector 517 (see FIG. 9). The second stop 523 is secured to the remote end of the second support member 502. The second stop 523 contains the second cavity 524 that captures and secures the second elongate resilient member 506 and the third elongate resilient member 528.

The third hole 533 may be of any shape that can allow the remote end of the third elongate resilient member 528 to pass through. In one embodiment, the third elongate resilient member 528 has a circular cross section and the third hole 533 has a circular shape. In another embodiment, the third elongate resilient member 528 has a polygonal cross section and the third hole 533 has the same polygonal shape.

In one embodiment, the third hole 533 has a surface recessed cavity (not shown) in a shape complementary to the shape of the first enlargement of the third elongate resilient member 528 to form a tight fit under pressure.

In one embodiment, the first enlargement of the third elongate resilient member 528 has a spherical shape and the recessed cavity (not shown) in the third hole 533 also has a complementary spherical shape. In one embodiment, the first enlargement of the third elongate resilient member 528 has a cylindrical shape and the recessed cavity (not shown) in the third hole 533 also has a complementary cylindrical shape. In one embodiment, the first enlargement of the third elongate resilient member 528 has a polygonal shape and the recessed cavity (not shown) in the third hole 533 also has a complementary polygonal shape.

The fourth hole 534 may be of any shape that can allow the remote end of the fourth elongate resilient member 529 to pass through. In one embodiment, the fourth elongate resilient member 529 has a circular cross section and the fourth hole 534 has a circular shape. In another embodiment, the fourth elongate resilient member 529 has a polygonal cross section and the fourth hole 534 has the same polygonal shape.

In one embodiment, the fourth hole 534 has a surface recessed cavity (not shown) in a shape complementary to the shape of the first enlargement of the fourth elongate resilient member 529 to form a tight fit under pressure.

In one embodiment, the rust enlargement of the fourth elongate resilient member 529 has a spherical shape and the recessed cavity (not shown) in the fourth hole 534 also has a complementary spherical shape. In one embodiment, the first enlargement of the fourth elongate resilient member 529 has a cylindrical shape and the recessed cavity (not shown) in the fourth hole 534 also has a complementary cylindrical shape. In one embodiment, the first enlargement of the fourth elongate resilient member 529 has a polygonal shape and the recessed cavity (not shown) in the fourth hole 534 also has a complementary polygonal shape.

A third stop 542 is secured to the remote end of the third support member 525. The third stop 542 contains a third cavity 543 that captures and secures the fourth elongate resilient member 529. The third stop 542 may be secured to the third support member 525 by a snap button (not shown) or any other suitable means.

In a similar fashion, the back-side (not shown) and the left side (not shown) of the exemplary portable structure 500 are constructed.

Figure 11:
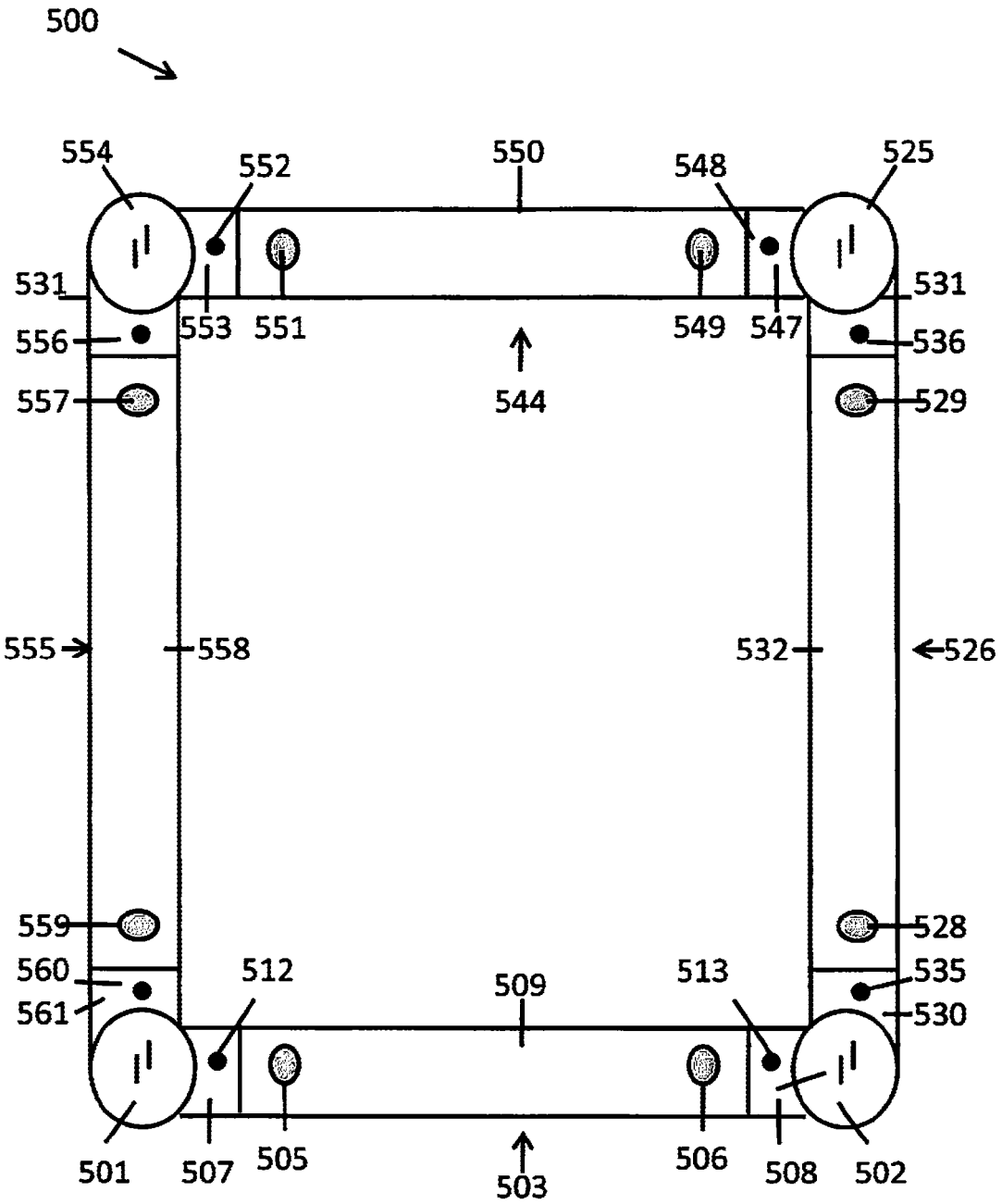
FIG. 11 is a top-view drawing illustrating an exemplary portable structure.

FIG. 11 is a top-view drawing illustrating an exemplary portable structure 500 that may be made using the bi-directional tensioning apparatus described herein. The portable structure 500 typically includes the first support member 501, the second support member 502, the third support member 525, the fourth support member 554, the first guide member 503, the first elongate resilient member 505, and the second elongate resilient member 506, the second guide member 526, the third elongate resilient member 528, the fourth elongate resilient member 529, the third guide member 544, the fifth elongate resilient member 549, the sixth elongate resilient member 551, the fourth guide member 555, the seventh elongate resilient member 557, and the eighth elongate resilient member 559. The first guide member 503 includes the first coupler 507, the second coupler 508, the first cylindrical tube 509, the first snap button 512, and the second snap button 513. The second guide member 526 includes the third coupler 530, the fourth coupler 531, the second cylindrical tube 532, the third snap button 535, and the fourth snap button 536. The third guide member 544 includes the fifth coupler 547, the sixth coupler 553, the third cylindrical tube 550, the fifth snap button 548, and the sixth snap button 552. The seventh guide member 555 includes the seventh coupler 531, the eighth coupler 561, the cylindrical tube 558, the seventh snap button 556, and the eighth snap button 560.

Figure 12:
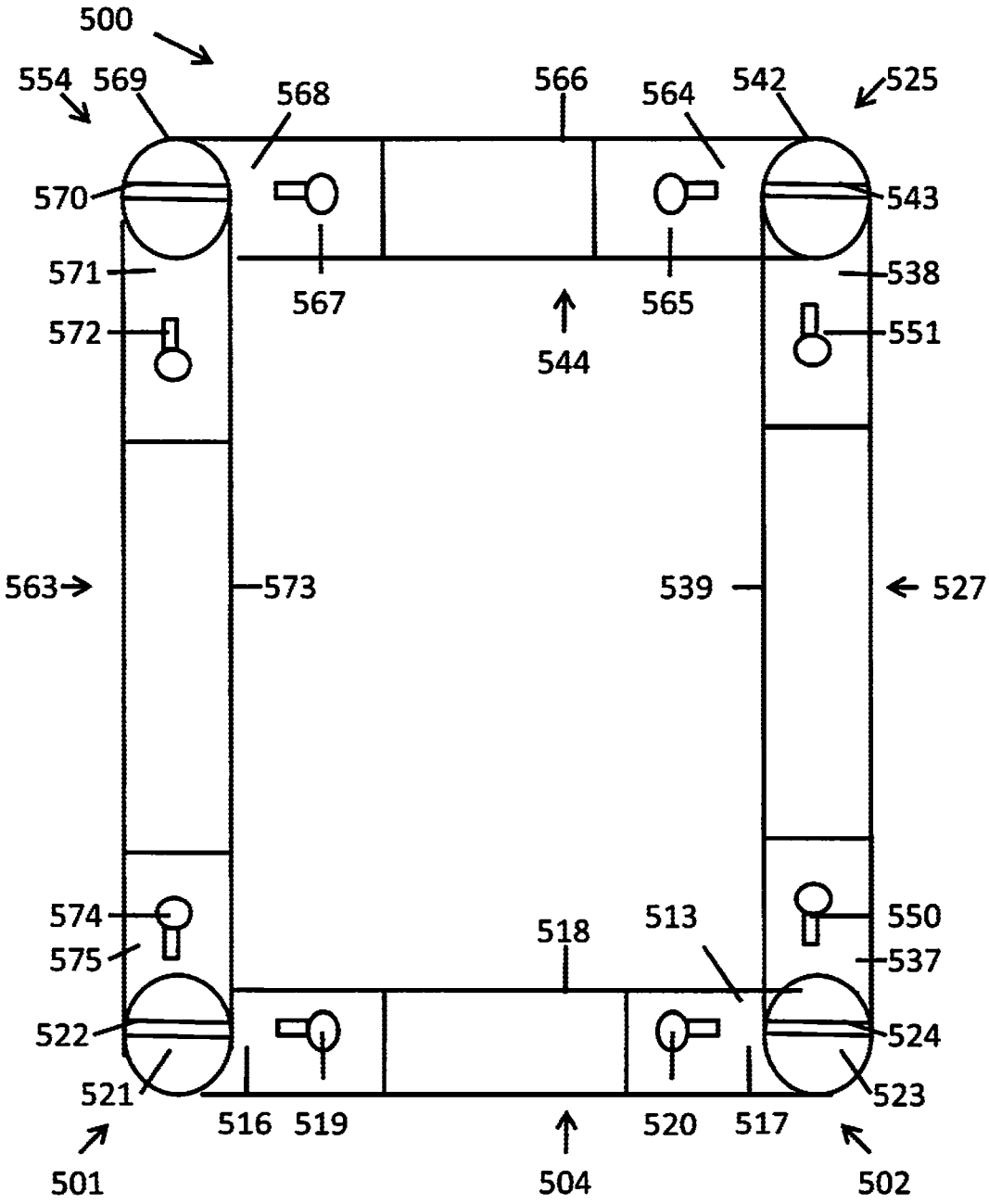
FIG. 12 is a bottom-view illustrating an exemplary portable structure.

FIG. 12 is a bottom-view drawing illustrating an exemplary portable structure 500 that may be made using the bi-directional tensioning apparatus described herein. The portable structure 500 typically includes the first support member 501, the second support member 502, the third support member 525, the fourth support member 554, the second guide member 504, the fourth guide member 527, the sixth guide member 544, and the eighth guide member 563. The second guide member 504 includes the first snap-fit connector 516, the second snap-fit connector 517, the second cylindrical tube 518, the first keyhole 519, and the second keyhole 520. The fourth guide member 527 includes the third snap-fit connector 537, the fourth snap-fit connector 538, the fourth cylindrical tube 539, the third keyhole 550, and the fourth keyhole 551. The sixth guide member 544 includes the fifth snap-fit connector 564, the sixth snap-fit connector 568, the sixth cylindrical tube 566, the fifth keyhole 565, and the sixth keyhole 567. The eighth guide member 563 includes the seventh snap-fit connector 571, the eighth snap-fit connector 575, the eighth cylindrical tube 573, the seventh keyhole 572, and the eighth keyhole 574.

The bottom or remote end of the first support member 501 includes the first stop 521, which contains the first cavity 522. The bottom or remote end of the second support member 502 includes the second stop 523, which contains the second cavity 524. The bottom or remote end of the third support member 525 includes the third stop 542, which contains the third cavity 543. The bottom or remote end of the fourth support member 554 includes the fourth stop 569, which contains the fourth cavity 570.

Figure 13:
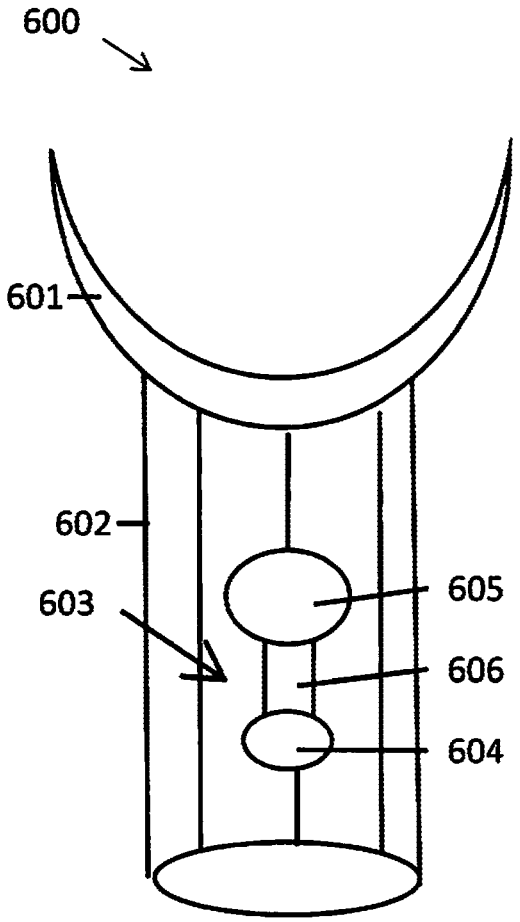
FIG. 13 is a top-view drawing illustrating an exemplary snap-fit connector.

FIG. 13 is a top-view drawing illustrating an exemplary snap-fit connector 600, which includes a snap-fitting 601, a cylindrical tube 602, and a keyhole 603. The snap-fitting 601 has an interior diameter slightly greater than the exterior diameter of the support member (not shown) so that it fits firmly into place with moderate pressure. The snap-fitting 601 is rigidly secured to the cylindrical tube 602 by adhesive or any other suitable means. The keyhole 603 includes a first hole 604 that is greater in thickness than the spaced-apart enlargements on the elongate resilient member (not shown), a second hole 605 that is less than the thickness of the spaced-apart enlargements on the elongate resilient member (not shown), and a key 606 that is greater than the thickness of the elongate resilient member, but less than the thickness of the spaced-apart enlargements on the elongate resilient member (not shown). Since a cylindrical tube 602 is used, the exact replica of the keyhole 603 is also made on the bottom-side of the cylindrical tube 602. With the snap-fit connector 600, the user inserts the remote end of the elongate resilient member (not shown) through the first hole 604 until the desired tension is achieved and one of the spaced-apart enlargements on the elongate resilient member (not shown) is contained within the cylindrical tube 602, pushes the elongate resilient member (not shown) through the key 606 and secures it into the second hole 605.

In another embodiment, the orientation of the keyhole 603 is reversed from the orientation shown in FIG. 13. In another embodiment, the orientation of the keyhole 603 is perpendicular to the length of the cylindrical tube 602 shown in FIG. 13. In another embodiment, the orientation of the keyhole 603 is at an angle not perpendicular nor parallel to the length of the cylindrical tube 602 shown in FIG. 13.

In another embodiment, the keyhole does not include the key 606. In that embodiment, the user inserts the remote end of the elongate resilient member (not shown) through the first hole 604 until the desired tension is achieved and one of the spaced-apart enlargements on the elongate resilient member (not shown) is contained within the cylindrical tube 602, pushes the elongate resilient member (not shown) directly into the second hole 605.

Figure 14:
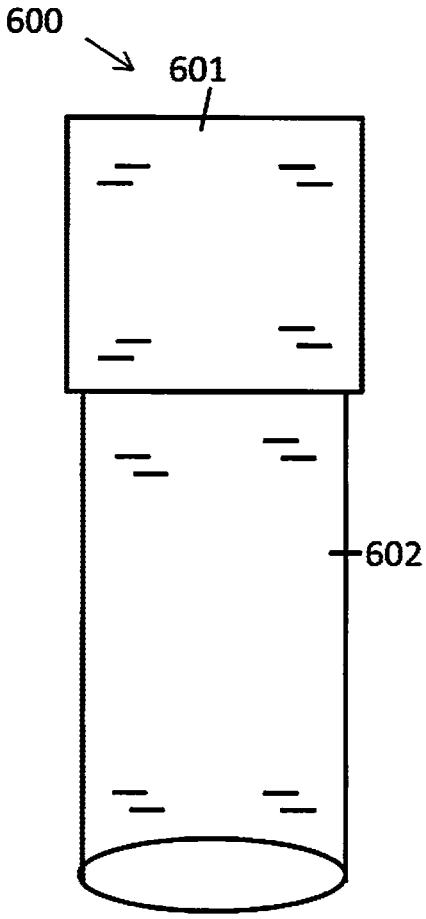
FIG. 14 is a side-view drawing illustrating an exemplary snap-fit connector.

FIG. 14 is a right side-view drawing illustrating an exemplary snap-fit connector 600 that illustrates the relationship between the snap-fitting 601 and cylindrical tube 602. The keyhole 603 is not shown.

Figure 15:
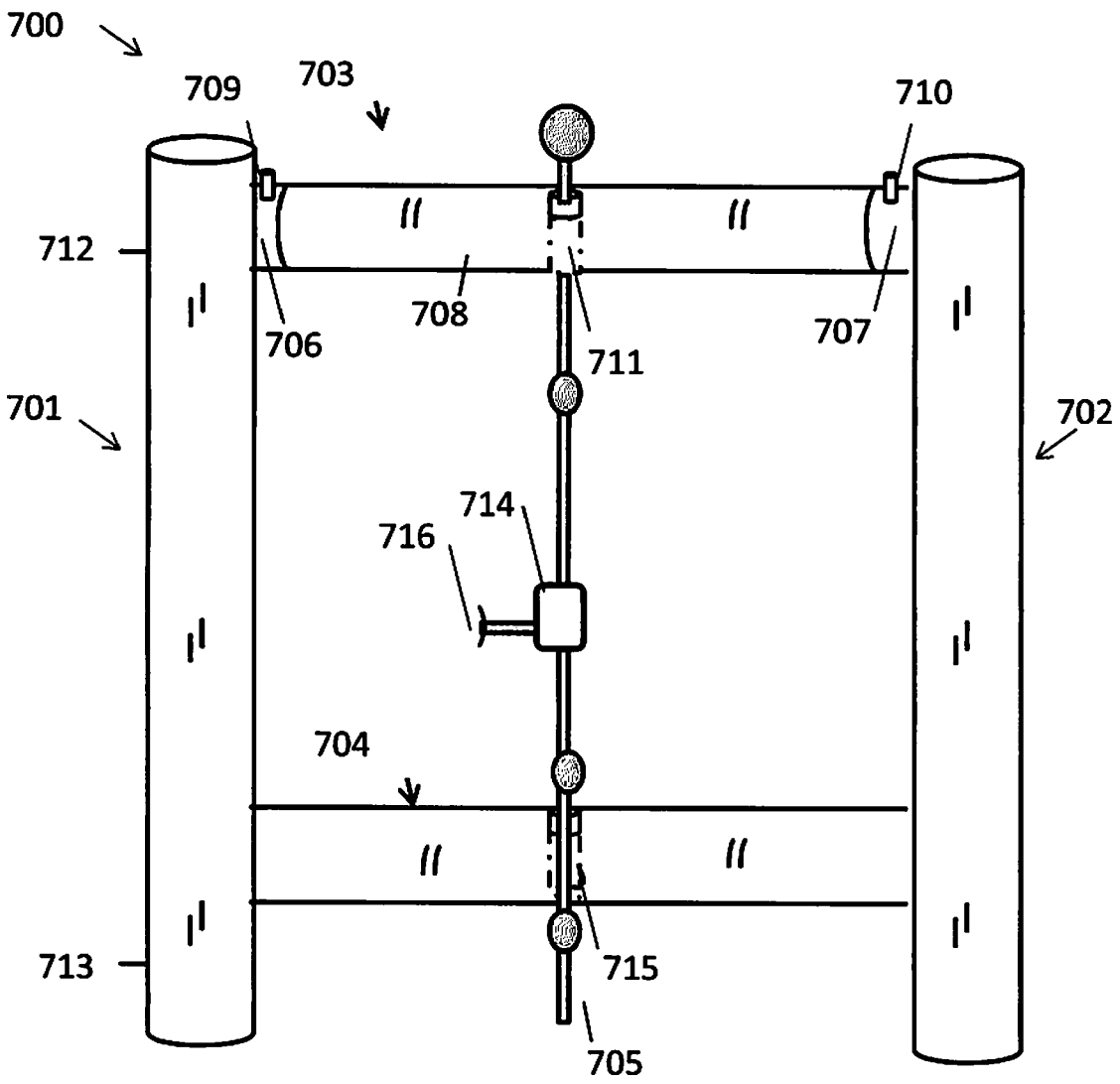
FIG. 15 is a perspective front-view drawing illustrating an exemplary bi-directional tensioning apparatus.

FIG. 15 is a perspective front-view drawing illustrating an exemplary bi-directional tensioning apparatus 700: The bi-directional tensioning apparatus 700 typically includes a first support member 701, a second support member 702, a first guide member 703, a second guide member 704, and an elongate resilient member 705. The first guide member 703 includes a first coupler 706, a second coupler 707, and a cylindrical tube 708. The cylindrical tube 708 has outside and inside diameters equals to that the first support member 701. The cylindrical tube 708 also contains a first hole 711 extending perpendicular through the cylindrical tube 708. When the cylindrical tube 708 is attached to the first coupler 706 and the second coupler 707, the first hole 711 is oriented in the direction parallel to the support member 701. The first hole 711 will allow the elongate resilient member 705 to pass through it up to the first enlargement. One end of the first coupler 706 is rigidly secured to a base end of the first support member 701, by adhesive or any other suitable means. One end of the second coupler 707 is rigidly secured to a base end of the second support member 702, by adhesive or any other suitable means. A separate hole (not shown) is formed in the cylindrical sidewall of each of the couplers 706 and 707, proximate the end of the two support members 701 and 702. Corresponding holes (not shown) are formed through the cylindrical sidewall of the cylindrical tube 708 proximate each end thereof. Snap buttons, of the type known in the art, are inserted into the corresponding holes (not shown) on both ends of the cylindrical tube 708, so that the first snap button 709 and the second snap button 710 each protrude out of their respective holes. One end of the cylindrical tube 708 is then inserted or "telescoped" into the first coupler 706 and arranged so that the first snap button 709 engages the hole through the sidewall thereof. One end of the cylindrical tube 708 is then inserted or "telescoped" into the second coupler 707 and arranged so that the second snap button 710 engages the hole through the sidewall thereof. In this manner, the cylindrical tube 708 is releasably connected to the first and second support members 701 and 702. The first support member 701 extends linearly from its base end 712 to a remote end 713.

The second guide member 704 is releasably attached to the first support member 701 and the second support member 702 with two snap buttons (not shown). The second guide member 704 also contains a first keyhole 715 extending perpendicular through the second guide member 704. The first keyhole 715 will allow the elongate resilient member 705 to pass through it and to engage one of the spaced-apart enlargements (not shown).

Exemplary keyholes are described herein below and shown in FIG. 13 above.

The first hole 711 may be of any shape that can allow the remote end of the elongate resilient member 705 to pass through. In one embodiment, the elongate resilient member 705 has a circular cross section and the first hole 711 has a circular shape. In another embodiment, the first elongate resilient member 705 has a polygonal cross section and the first hole 711 has the same polygonal shape.

In one embodiment, the first hole 711 has a surface recessed cavity (not shown) in a shape complementary to the shape of the first enlargement of the elongate resilient member 705 to form a tight fit under pressure.

In one embodiment, the first enlargement of the elongate resilient member 705 has a spherical shape and the recessed cavity (not shown) in the first hole 711 also has a complementary spherical shape. In one embodiment, the first enlargement of the elongate resilient member 705 has a cylindrical shape and the recessed cavity (not shown) in the first hole 711 also has a complementary cylindrical shape. In one embodiment, the first enlargement of the elongate resilient member 705 has a polygonal shape and the recessed cavity (not shown) in the first hole 711 also has a complementary polygonal shape.

The second hole 715 may be of any shape that can allow the remote end of the elongate resilient member 705 to pass through. In one embodiment, the elongate resilient member 705 has a circular cross section and the second hole 715 has a circular shape. In another embodiment, the elongate resilient member 705 has a polygonal cross section and the second hole 715 has the same polygonal shape.

In one embodiment, the second hole 715 has a surface recessed cavity (not shown) in a shape complementary to the shape of an enlargement of the elongate resilient member 705 to form a tight fit under pressure.

The coupler 714 contains a keyhole (not shown) extending perpendicular thereof. The keyhole (not shown) will allow the elongate resilient member 705 to pass through it and to engage one of the spaced-apart enlargements (not shown). Exemplary keyholes are described herein below and shown in FIG. 13 above. The coupler 714 may be linked via connection 716 to a pulley system (not shown) to a user (not shown) to allow the bi-directional tensioning apparatus 700 to function as a resistance system commonly found in a Universal Gym (BMI Karts & Supply, Versailles, Ohio, 45380), without the need for heavy weights.

Figure 16:
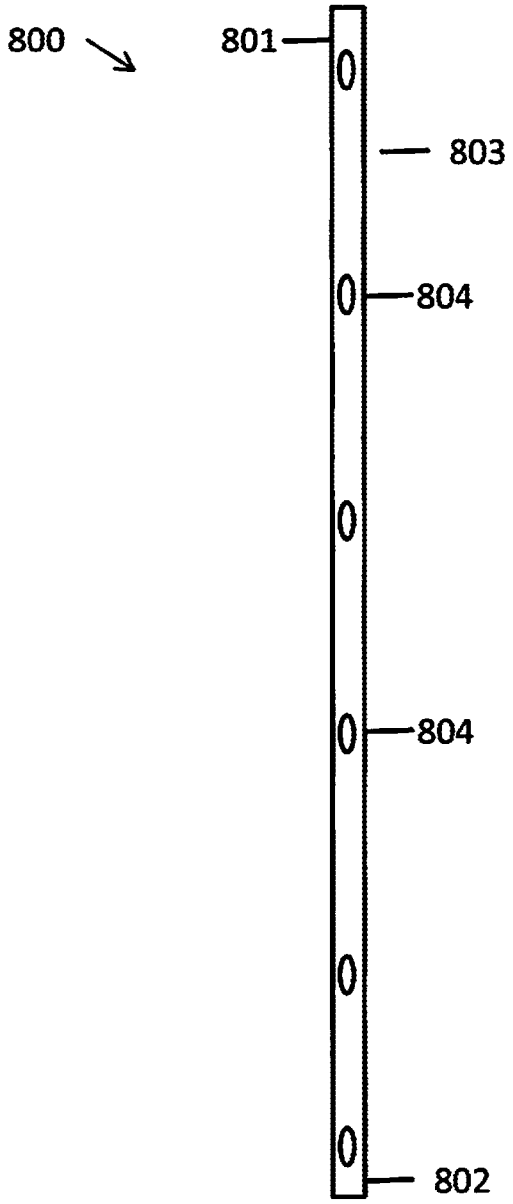
FIG. 16 is a front-view drawing illustrating an exemplary resilient member.

FIG. 16 is a front-view drawing illustrating an exemplary resilient member 800. The resilient member 800 having a base end 801 and a remote end 802. The resilient member 800 includes a resilient material 803 and holes 804 along the length of the resilient member 800.

In one embodiment, the resilient member 800 may be made of, for example, a styrene-butadiene rubber or a chloroprene (i.e., neoprene) rubber. The resilient member 800 has excellent memory characteristics and returns to its original shape after numerous elongations.

The resilient member 800 may be also be made of any other suitable elastic material, for example, natural rubber, synthetic polyisoprene, butyl rubber (copolymer of isobutylene and isoprene), halogenated butyl rubber, polybutadiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 1000 to about 9000, and a percentage elongation to about 900. The elastic material should also possess, for example, good abrasion resistance, good tear resistance, and good ozone resistance.

In one embodiment, the resilient member 800 may include an enlargement (not shown) at the base end 801. The enlargement (not shown) may be, for example, of any shape that prevents the resilient member 800 from sliding through one of the first guide members described herein. The enlargement (not shown) may be, for example, a cylindrical shape, a spherical shape, a square shape, a polygonal shape, and the like. Preferably, the enlargement (not shown) has a cylindrical shape. More preferably, the enlargement (not shown) has a cylindrical shape with a bevel edge on the side of the enlargement (not shown) opposite the first guide member to provide reinforcement.

Figure 17:
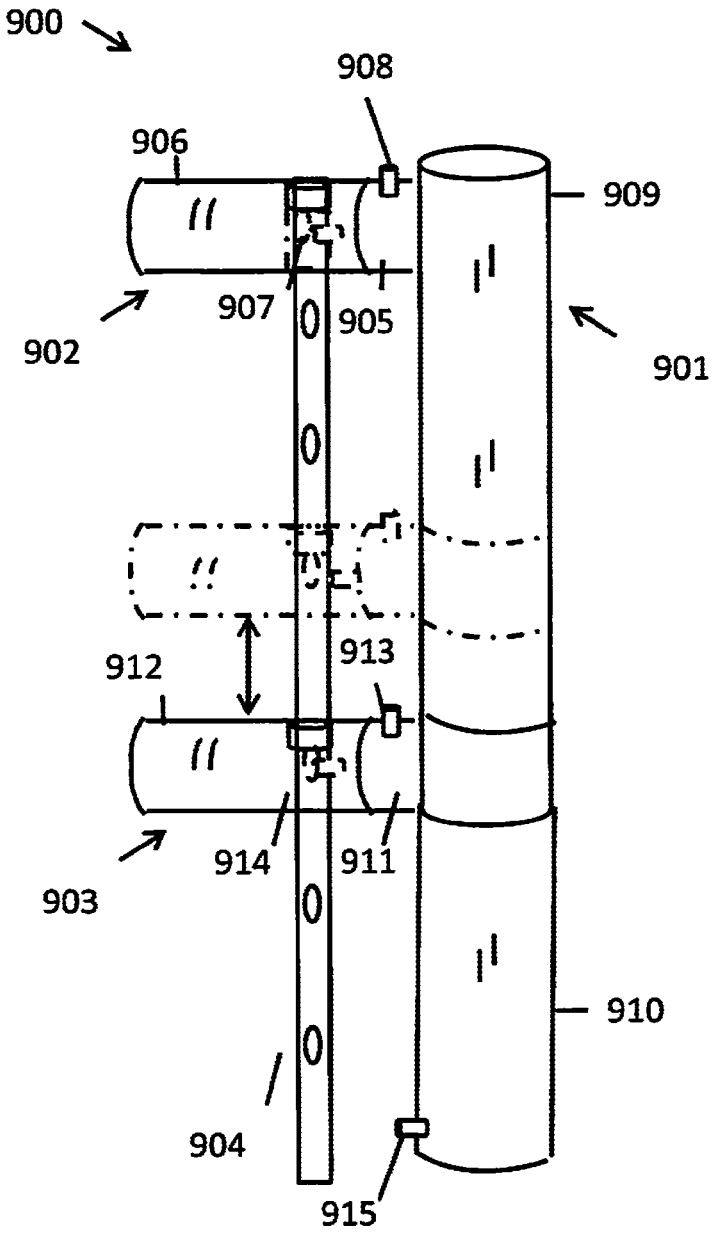
FIG. 17 is a perspective front-view drawing illustrating an exemplary bi-directional tensioning apparatus.

FIG. 17 is a perspective front-view drawing illustrating an exemplary bi-directional tensioning apparatus 900. The bi-directional tensioning apparatus 900 typically includes a support member 901, a first guide member 902, a second guide member 903, and elongate resilient member 904. The first guide member 902 includes a first coupler 905 and a first cylindrical tube 906. The first cylindrical tube 906 has an outside and an inside diameters equal to that the support member 901. The first cylindrical tube 906 also contains a first hole 907 extending perpendicular through the first cylindrical tube 906. When the first cylindrical tube 906 is attached to the first coupler 905, the first hole 907 is oriented in the direction parallel to the support member 901. The first hole 907 will allow the elongate resilient member 904 to pass through it and be connecter with the compression pin (not shown).

One end of the first coupler 905 is rigidly secured to a base end of the support member 901, by adhesive or any other suitable means. A separate hole (not shown) is formed in the cylindrical sidewall of the first coupler 905, proximate the end of the support member 901. A corresponding hole (not shown) is formed through the cylindrical sidewall of the first cylindrical tube 906 proximate the end thereof. A snap button, of the type known in the art, is inserted into the corresponding hole (not shown) on one end of the first cylindrical tube 906, so that the first snap button 908 protrudes out of the hole. One end of the first cylindrical tube 906 is then inserted or "telescoped" into the first coupler 905 and arranged so that the first snap button 908 engages the hole through the sidewall thereof. In this manner, the first cylindrical tube 906 is releasably connected to the support member 901. The support member 901 extends linearly from its base end 909 to a remote end 910. The second guide member 903 includes the second coupler 911 and the second cylindrical tube 912. The second coupler 911 may be a snap-fit connector. An exemplary snap-fit connector is described herein below and shown in FIG. 18.

The second cylindrical tube 912 has an outside and an inside diameter equal to that the support member 901. A corresponding hole (not shown) is formed through the cylindrical sidewall of the second cylindrical tube 912 proximate the end thereof. A snap button, of the type known in the art, is inserted into one end of the second cylindrical tube 912, so that the second snap button 913 protrudes out of the hole. One end of the second cylindrical tube 912 is then inserted or "telescoped" into the second coupler 911 and arranged so that the second snap button 913 engages the hole through the sidewall thereof. In this manner, the second cylindrical tube 912 is releasably connected to the support member 901. The second cylindrical tube 912 also contains a connector 914 also extending perpendicular through the second cylindrical tube 912. When the second cylindrical tube 912 is attached to the second coupler 911, the connector 914 is oriented in the direction parallel to the support member 901. The connector 914 will allow the first elongate resilient member 904 to pass through it and to engage one of the holes (not shown). Exemplary connectors are described herein below and shown in FIG. 18.

A connector 915 is secured to the remote end 910 of the support member 901. The connector 915 captures one of the holes and secures the elongate resilient member 904. In one embodiment, the second guide member 903 includes the second coupler 911 and the second cylindrical tube 912. In another embodiment, the second guide member 903 is a second cylindrical tube (not shown) with a coupler end.

Figure 18:
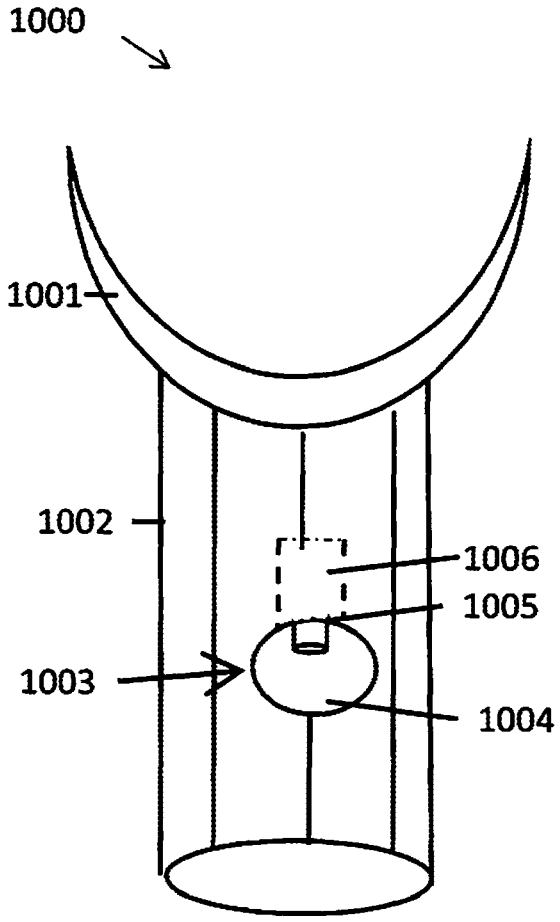
FIG. 18 is a top-view drawing illustrating an exemplary snap-fit connector.

FIG. 18 is a top-view drawing illustrating an exemplary snap-fit connector 1000, which includes a snap-fitting 1001, a cylindrical tube 1002, and a connector 1003. The snap-fitting 1001 has an interior diameter slightly greater than the exterior diameter of the support member (not shown) so that it fits firmly into place with moderate pressure. The snap-fitting 1001 is rigidly secured to the cylindrical tube 1002 by adhesive or any other suitable means. The connector 1003 includes a hole 1004. Since a cylindrical tube 1002 is used, the exact replica of the connector 1003 is also made on the bottom-side of the cylindrical tube 1002. With the snap-fit connector 1000, the user inserts the remote end of the elongate resilient member (not shown) through the hole 1004 until the desired tension is achieved and one of the holes on the elongate resilient member (not shown) is contained within the cylindrical tube 1002, pushes the hole in the elongate resilient member (not shown) through the pin 1005 and secures it. The pin 1005 is held in position by the compression spring 1006 located within the cylindrical tube 1002.

In another embodiment, the orientation of the connector 1003 is reversed from the orientation shown in FIG. 18. In another embodiment, the orientation of the connector 1003 is perpendicular to the length of the cylindrical tube 1002 shown in FIG. 18. In another embodiment, the orientation of the connector 1003 is at an angle not perpendicular nor parallel to the length of the cylindrical tube 1002 shown in FIG. 18.

Figure 19:
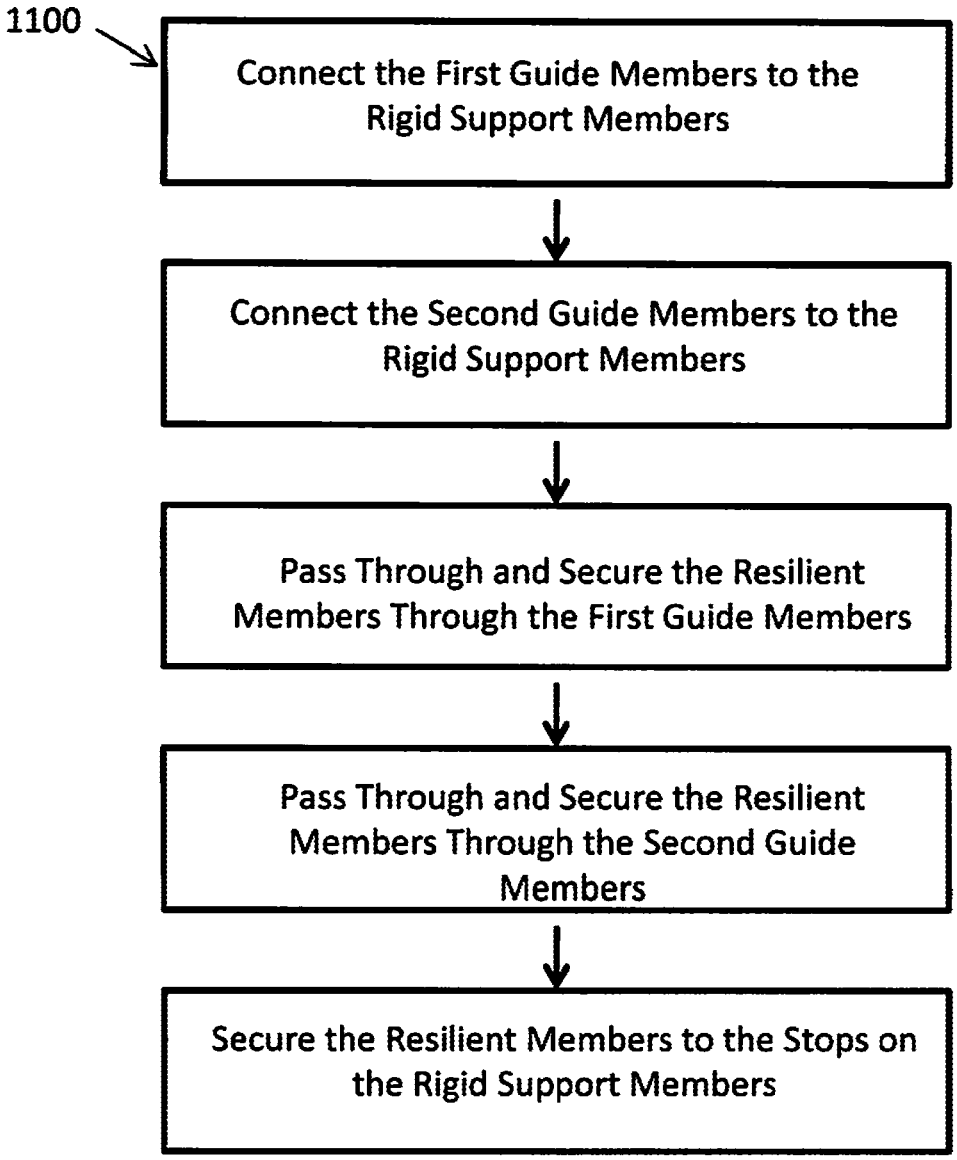
FIG. 19 is a block diagram illustrating an exemplary method of assembling an exemplary bi-directional tensioning device.

FIG. 19 is a block diagram illustrating an exemplary method of assembling an exemplary bi-directional tensioning device 1100. The method 1100 includes: connecting the one or more first guide members to base end or proximate the base end of each of the one or more support members; connecting the one or more optional second guide members to the one or more support members at a position intermediate the base end and the remote end of the one or more support members; passing the remote ends of each of the one or more elongate resilient members through the first hole extending through the one or more first guide members toward the remote end of the one or more support members and securing each first enlargement; and passing the remote ends of each of the one or more elongate resilient members through the first hole extending through the one or more optional second guide members toward the remote end of the one or more support members; and securing one of the spaced-apart enlargements on the one or more optional second guide members.

The present invention also provides various portable structures by slightly modifying the components of the exemplary bi-directional tensioning apparatus 400 (see FIG. 6). For example, if four three-way 90 degree couplers are substituted for each of the two couplers 407 and 408 that would be found in two bi-directional tensioning apparatuses 400, the two modified bi-directional tensioning apparatuses can be linked together by a third and a fourth first guide members and a third and a fourth second guide members to provide a box-type portable structure. Likewise, a three-sided structure may be formed using three support members, each having a three-way 60-degree coupler, with three first guide members and three second guide members. In a similar fashion, a five-sided, a six-sided, a seven-sided, an eight-multi-sided structure can be formed by varying the angle on the three-way couplers.

The present invention also provides various fence structures by slightly modifying the components of the exemplary bi-directional tensioning apparatus 400. For example, a fence structure may be formed using three support members, two having two-way 90-degree couples and the third having a three-way 180 degree coupler, with three first guide members and three second guide members.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention. Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A bi-directional tensioning exercise apparatus comprising:

a support member that has a first end and a second end;

an elongate resilient member that has a first end, a second end, and one or more enlargements that are spaced between the first end and the second end of the elongate resilient member, wherein the elongate resilient member comprises an elastic material, and wherein the first and second ends of the elongate resilient member are secured at or proximate to the first and second ends of the support member, respectively, so that the elongate resilient member extends along a length of the support member; and a guide member that has a first end, a second end, and a connector that is located between the first end and the second end of the guide member, wherein the first end of the guide member is coupled to the support member such that the guide member can slide along the length of the support member, wherein the connector is adjustable located to engage one or more of the enlargements of the elongate resilient member so as to provide the guide member with bi-directional tension along the length of the support member; whereby a user can move the guide member and have said variable tension provided by said resilient member.

2. The bi-directional tensioning apparatus of claim 1, wherein the connector comprises one or more openings in the guide member that are sized to permit the elongate resilient member, when in a first position relative to the openings, to pass through the guide member, and, when in a second position relative to the openings, to engage the connector of the guide member.

3. The bi-directional tensioning apparatus of claim 1, wherein the one or more enlargements have a radius that is greater than a radius of one or more portions of the elongate resilient member that are located between the one or more enlargements along the elongate resilient member.

4. The bi-directional tensioning apparatus of claim 3, wherein the one or more enlargements comprise one or more knots in the elongate resilient member.

5. The bi-directional tensioning apparatus of claim 3, wherein the one or more enlargements comprise a material that is selected from the group consisting of: the elastic material, a wooden material, a metal material, and a plastic material.

6. The bi-directional tensioning apparatus of claim 1, wherein at least a portion of the elastic material includes natural rubber or synthetic rubber.

7. The bi-directional tensioning apparatus of claim 1, wherein the elastic material comprises a bungee cord.

8. The bi-directional tensioning apparatus of claim 1, wherein the connector comprises a keyhole that has at least two differently dimensioned portions that extend through the guide member.

9. The bi-directional tensioning apparatus of claim 8, wherein the two differently dimensioned portions comprise a first opening and a second opening that are connected to each other, wherein the first and second openings each extend through the guide member, wherein the first opening has a radius that is greater than a radius of the one or more enlargements and the second opening has a radius that is less than the radius of the one or more enlargements.

10. The bi-directional tensioning apparatus of claim 8, wherein the keyhole is oriented generally parallel to the support member.

11. The bi-directional tensioning apparatus of claim 8, wherein the keyhole is oriented generally perpendicular to the support member.

12. The bi-directional tensioning apparatus of claim 1, wherein the connector is selected from the group consisting of: a hook, a clamp, a stricture, a slot, a grommet, and a capture.

13. The bi-directional tensioning apparatus of claim 1, wherein the connector engages the one or more of the enlargements from within an interior of the guide member.

14. The bi-directional tensioning apparatus of claim 1, wherein the connector engages the one or more of the enlargements at or proximate to an exterior surface of the guide member.

15. A bi-directional tensioning exercise apparatus comprising:

a first support member that has a first end and a second end;

a base member that is coupled, at a first end of the base member, to the first end of the first support member and that extends generally perpendicular to the first support member;

a second support member that has a first end and a second end, wherein the first end of the second support member is coupled to a second end of the base member such that the second support member is generally perpendicular to the base member and generally parallel to the first support member;

an elongate resilient member that has a first end, a second end, and one or more enlargements that are spaced between the first end and the second end of the elongate resilient member, wherein the elongate resilient member comprises an elastic material, and wherein the first end of the elongate resilient member is secured to the base member and second end of the elongate resilient member is secured at or proximate to the second end of the first support member so that the elongate resilient member extends along a length of the first support member; and a guide member that has a first end, a second end, and a connector that is located between the first end and the second end of the guide member, wherein the first end of the guide member is coupled to the first support member and the second end of the guide member is coupled to the second support member such that the guide member can slide along the length of the first and second support members, wherein the connector is configured to engage one or more of the enlargements of the elongate resilient member so as to provide the guide member with bi-directional tension along the length of the first and second support members; whereby a user can move the guide member and have said variable tension provided by said resilient members.

16. The bi-directional tensioning apparatus of claim 15, wherein the first end of the elongate resilient member is secured to the base member at a point that is generally midway between the first and second ends of the base member.

17. The bi-directional tensioning apparatus of claim 15, wherein:

the apparatus further comprises a second elongate resilient member that has a first end, a second end, and one or more enlargements that are spaced between the first end and the second end of the second elongate resilient member, wherein the second elongate resilient member comprises an elastic material, and wherein the first end of the second elongate resilient member is secured to the base member and second end of the second elongate resilient member is secured at or proximate to the second end of the second support member so that the second elongate resilient member extends along a length of the second support member;

the guide member further comprises a second connector that is located between the first end and the second end of the guide member, wherein the second connector is configured to engage one or more of the enlargements of the second elongate resilient member so as to provide the guide member with bi-directional tension along the lengths of the first and second support members.

18. A bi-directional tensioning exercise apparatus comprising:

a generally U-shaped frame that has a base member, a first support member, and a second support member, wherein a first end of the first support member extends from a first end of the base member, wherein a first end of the second support member extends from a second end of the base member, wherein the first and second support members extend generally parallel to each other, wherein the first and second support members extend generally perpendicular to the base member;

first and second elongate resilient members that each have a first end, a second end, and one or more enlargements that are spaced between the first end and the second end of the first and second elongate resilient members, respectively, wherein the first and second elongate resilient members each comprise an elastic material, and wherein the first ends of the first and second elongate resilient members are secured to the base member and the second ends of the first and second elongate resilient members are secured at or proximate to the second ends of the first and second support members, respectively, so that the first and second elongate resilient members extend along a length of the first support member and a length of the second support member, respectively; and a guide member that has a first end, a second end, a first connector, and a second connector, wherein the first end of the guide member is coupled to the first support member and the second end of the guide member is coupled to the second support member such that the guide member can slide along the length of the first and second support members, wherein the first and second connectors are configured to engage one or more of the enlargements of the first and second elongate resilient members, respectively, so as to provide the guide member with bi-directional tension along the length of the first and second support members; whereby a user can move the guide member and have said variable tension provided by said resilient members.

19. The bi-directional tensioning apparatus of claim 18, wherein the first and second connectors comprise one or more openings in the guide member that are sized to permit the first or second elongate resilient member, when in a first position relative to the openings, to pass through the guide member, and, when in a second position relative to the openings, to engage the first or second connector of the guide member.

20. The bi-directional tensioning apparatus of claim 18, wherein the base member is detachably coupled to the first and second support members.

* * * * *